US009592973B2

(12) United States Patent
Kushida et al.

(10) Patent No.: US 9,592,973 B2
(45) Date of Patent: Mar. 14, 2017

(54) SHEET FEEDING APPARATUS AND IMAGE FORMING APPARATUS

(71) Applicant: CANON KABUSHIKI KAISHA, Tokyo (JP)

(72) Inventors: Hideki Kushida, Moriya (JP); Tomohito Nakagawa, Kashiwa (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/667,966

(22) Filed: Mar. 25, 2015

(65) Prior Publication Data

US 2015/0284195 A1 Oct. 8, 2015

(30) Foreign Application Priority Data

Apr. 4, 2014 (JP) ..... 2014-077862

(51) Int. Cl.
*B65H 7/02* (2006.01)
*B65H 1/14* (2006.01)
(Continued)

(52) U.S. Cl.
CPC ..... *B65H 1/14* (2013.01); *B65H 1/18* (2013.01); *B65H 1/24* (2013.01); *B65H 3/06* (2013.01); *B65H 7/02* (2013.01); *B65H 7/20* (2013.01)

(58) Field of Classification Search
CPC ... B65H 1/04; B65H 7/02; B65H 7/04; B65H 7/06; B65H 7/14
(Continued)

(56) References Cited

U.S. PATENT DOCUMENTS 4,817,877 A * 4/1989 Itoh et al. ..... 241/34
5,009,410 A * 4/1991 Fujii et al. ..... 271/127
(Continued)

FOREIGN PATENT DOCUMENTS

JP 3-26637 * 2/1991
JP 6-56305 * 3/1994
(Continued)

OTHER PUBLICATIONS

Machine translation of JP6-56305.*

*Primary Examiner* — Thomas Morrison
(74) *Attorney, Agent, or Firm* — Fitzpatrick, Cella, Harper & Scinto

(57) ABSTRACT

A sheet feeding apparatus includes a stacking portion, a lifting portion, a feeding portion, and a control portion. The sheet feeding apparatus further includes a first height detecting portion configured to output a signal corresponding to a position in a height direction of the topmost sheet of sheets stacked on the stacking portion, a sheet presence detecting portion configured to output a signal corresponding to presence or absence of the sheets stacked on the stacking portion, and a second height detecting portion configured to output a signal corresponding to a position in a height direction of the stacking portion. The control portion performs control for sheet feeding operation using the signal from the sheet presence detecting portion if the position of the stacking portion is above a predetermined height based on the signal from the second height detecting portion and, if the position of the stacking portion is below the predetermined height, the control portion performs control for sheet feeding operation not using the sheet presence detecting portion.

15 Claims, 15 Drawing Sheets

(51) Int. Cl.

| | |
|---|---|
| ***B65H 1/18*** | (2006.01) |
| ***B65H 1/24*** | (2006.01) |
| ***B65H 3/06*** | (2006.01) |
| ***B65H 7/20*** | (2006.01) |

(58) Field of Classification Search

USPC ..... 271/110, 111, 114, 117, 118, 265.01, 271/258.01, 259, 265.02, 258.04, 265.03, 271/262, 263, 127, 30.1, 155, 31, 128, 271/152

See application file for complete search history.

(56) References Cited

U.S. PATENT DOCUMENTS

| | | | | |
|---|---|---|---|---|
| 5,351,112 | A | 9/1994 | Naito et al. | |
| 5,455,667 | A | 10/1995 | Hiroi et al. | |
| 5,552,859 | A | 9/1996 | Nakagawa et al. | |
| 5,579,083 | A | 11/1996 | Naito et al. | |
| 5,819,151 | A | 10/1998 | Naito et al. | |
| 5,833,230 | A | 11/1998 | Nakagawa et al. | |
| 6,098,977 | A | 8/2000 | Sato et al. | |
| 6,131,898 | A | 10/2000 | Hiroi et al. | |
| 7,034,925 | B2 | 4/2006 | Kamiyama et al. | |
| 7,419,150 | B2 | 9/2008 | Kushida et al. | |
| 7,540,489 | B2 | 6/2009 | Kushida | |
| 7,703,758 | B2 | 4/2010 | Kamiya et al. | |
| 7,874,553 | B2 | 1/2011 | Kushida et al. | |
| 8,424,863 | B2 * | 4/2013 | Kita et al. | 271/9.03 |
| 8,550,461 | B2 | 10/2013 | Sekigawa et al. | |
| 8,651,480 | B2 | 2/2014 | Watanabe et al. | |
| 8,876,105 | B2 * | 11/2014 | Ohtani et al. | 271/152 |
| 2006/0208414 | A1 * | 9/2006 | Amarakoon et al. | 271/10.02 |
| 2015/0021850 | A1 | 1/2015 | Nakagawa | |
| 2015/0042037 | A1 | 2/2015 | Nakagawa et al. | |

FOREIGN PATENT DOCUMENTS

| | | | |
|---|---|---|---|
| JP | 2000-327177 | * | 11/2000 |
| JP | 2006-103949 A | | 4/2006 |

* cited by examiner

SHEET FEEDING APPARATUS AND IMAGE FORMING APPARATUS

BACKGROUND OF THE INVENTION

Field of the Invention

This disclosure relates to a sheet feeding apparatus and image forming apparatus capable of feeding a sheet having an uneven thickness such as an envelope.

Description of the Related Art

An image forming apparatus such as a copier, facsimile apparatus, printer, or multi-function machine has a sheet feeding apparatus that separately feeds sheets on a one-by-one basis stacked on a sheet stacking portion toward an image forming portion. Recently, as an on-demand digital printing market extends, there is a growing printing need for a large variety of sheets in addition to conventional standard-size cut sheets.

For example, an image forming apparatus performs printing on an envelope, an emboss sheet with an uneven surface decorated with characters or pictures, or a preprinted sheet on which a toner image or ink has been printed in advance partly. In the case of envelopes, when a large number of envelopes are stacked on a sheet stacking portion of an image forming apparatus to print addresses or the like, the thickness of each envelope varies partly between an overlapping part of a bag portion and a flap portion such as a turnup of each envelope, thereby causing a large difference in the thickness of an envelope bundle partly. In addition, in the case of partly embossed sheets or preprinted sheets on which an image toner or ink has been printed partly as a thick layer, a large difference may be caused in the thickness of a sheet bundle partly, as in the case of envelopes to be set on the sheet stacking portion.

When a large number of such sheets having partly different thickness are stacked on the sheet stacking portion and fed on a one-by-one basis, height differences are caused on the upper surface of a stacked sheet bundle. The height differences of the upper surface of the sheet bundle make a contact pressure (feeding pressure) between a feeding roller for feeding the sheets and the topmost sheet uneven. When the feeding roller feeds the sheets in a state in which the contact pressure is uneven, a sheet feeding failure such as oblique conveyance or duplicate feeding may be caused. Accordingly, for example, Japanese Patent Laid-open No. 2006-103949 proposes a sheet feeding cassette that can reduce the height differences of the upper surface of the stacked sheet bundle by providing a bottom of the sheet bundle partly on a feeding tray on which the sheet bundle is stacked.

However, in the above configuration, although a sheet with an uneven thickness such as an envelope can be fed from the sheet feeding cassette smoothly, the maximum number of sheets that can be fed from the sheet feeding cassette for each replenishment is approximately 250 to 500.

To meet a recent need for continuously feeding and printing a large number of sheets at high speed, there has been a large capacity sheet feeding apparatus that has a lifter mechanism for elevating or lowering a sheet stacking portion on which sheets are stacked while keeping its attitude horizontal to feed the topmost sheet sequentially. This large capacity sheet feeding apparatus can replenish one thousand to several thousand sheets to the sheet stacking portion at a time and feed a large number of sheets continuously. In this sheet feeding apparatus, the lifter mechanism lifts the sheet stacking portion based on detection of the upper surface of the sheets by a sheet height detection sensor to keep the upper surface of stacked sheets at a height at which a sheet feed unit such as a feeding roller can feed the sheets.

However, when sheets with an uneven thickness such as envelopes or emboss sheets are stacked on the sheet stacking portion, the sheets may be stacked and fed in a state in which the flap portions of envelopes or thick portions of the sheets face the downstream side in a sheet feeding direction. In this case, on the upper surface of the stacked sheet bundle, the downstream side in the sheet feeding direction is higher and an upstream side is lower. Particularly in the large capacity sheet feeding apparatus, a large number of sheets are stacked, so the height difference between the downstream side and the upstream side in the sheet feeding direction on the upper surface of the stacked sheets becomes large. On the other hand, in the sheet feeding apparatus, there are cases where a sheet height detection sensor for detecting the upper surface of the sheets is disposed downstream in the sheet feeding direction and a sheet presence detection sensor for detecting presence or absence of sheets is disposed upstream of the sheet height detection sensor.

In the sheet feeding apparatus in which these detection sensors are disposed as described above, when the stacked sheets having a large height difference on the upper surface are continuously fed, "NO SHEET" may be detected erroneously even though sheets remain on the sheet stacking portion. Such erroneous detection occurs when the upstream side in sheet feeding direction is significantly lower than the downstream side on the upper surface of the stacked sheet bundle.

In a state in which the upper surface of the sheets is kept at a height at which the sheets can be fed based on detection by the sheet height detection sensor located downstream, if the upstream side is significantly lower than the downstream side on the upper surface of the sheets, the sheet presence detection sensor disposed upstream may not detect the upper surface of the sheets. Accordingly, a control portion erroneously detects "NO SHEET" based on a signal from the sheet presence detection sensor. Therefore, it may cause a disadvantage that a sheet feeding operation is stopped even though sheets remain on the sheet stacking portion.

SUMMARY OF THE INVENTION

According to this disclosure, there is provided a sheet feeding apparatus including: a stacking portion on which sheets are stacked, the stacking portion being movable up and down; a lifting portion which lifts the stacking portion; a feeding portion which abuts against a topmost sheet of the sheets stacked on the stacking portion, and feeds the topmost sheet; a first height detecting portion which outputs a signal corresponding to a position in a height direction of the topmost sheet of the sheets stacked on the stacking portion; a sheet presence detecting portion which outputs a signal corresponding to presence or absence of the sheets stacked on the stacking portion; and a second height detecting portion which outputs a signal corresponding to a position in a height direction of the stacking portion, wherein a lifting operation, of the lifting portion, that the position of the topmost sheet is kept within a certain range by lifting the stacking portion is controlled by a control portion based on the signal from the first height detecting portion and the signal from the sheet presence detecting portion while the second height detecting portion is outputting a signal when the position of the stacking portion is above a predetermined height, and the lifting operation of the lifting portion is controlled by the control portion based on the signal from the first height detecting portion and regardless of the signal from the sheet presence detecting portion while the second height detecting portion is outputting a signal when the position of the stacking portion is below the predetermined height.

Further features of the present invention will become apparent from the following description of exemplary embodiments with reference to the attached drawings.

DESCRIPTION OF THE EMBODIMENTS

Figure 1:
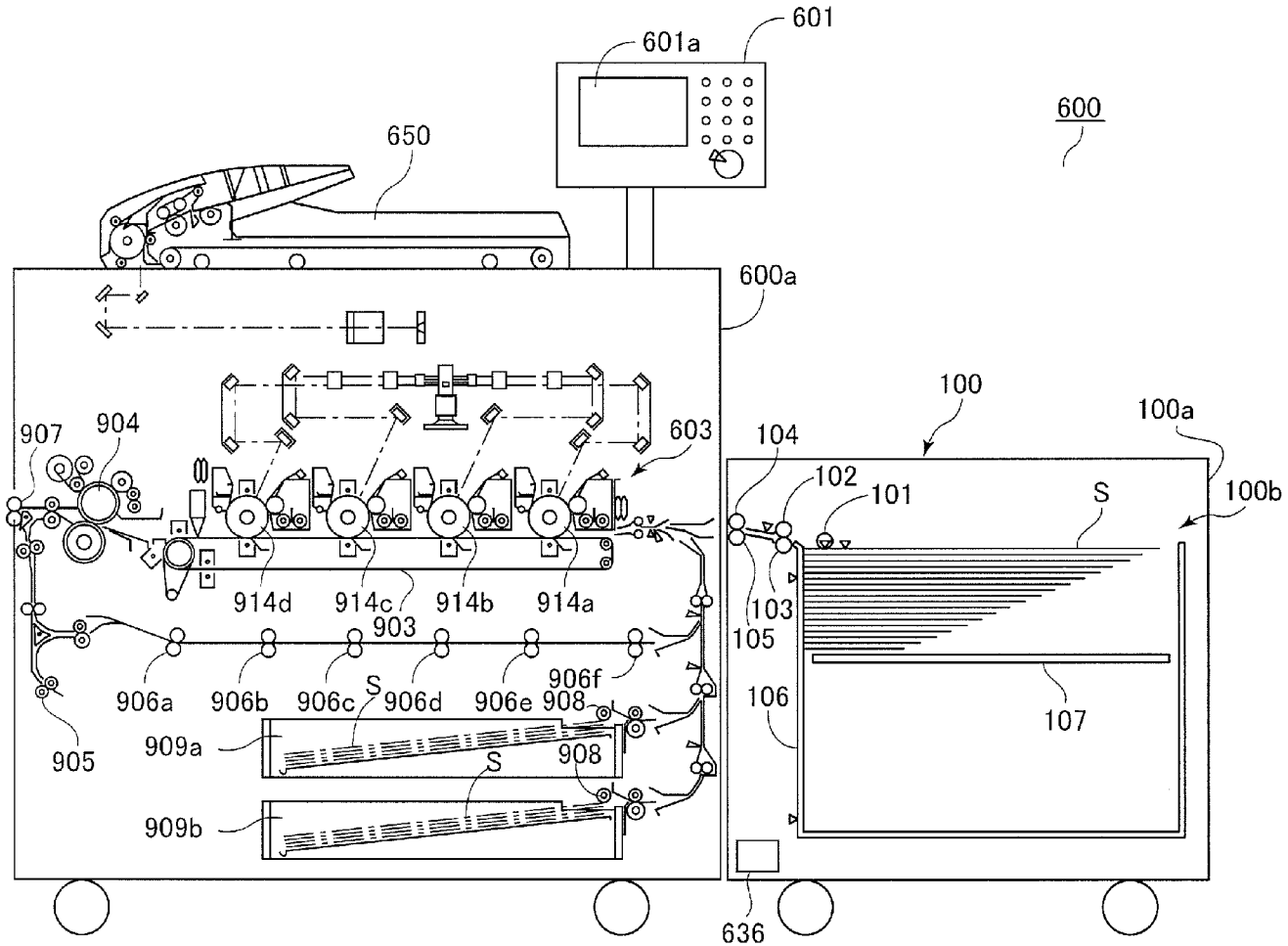
FIG. 1 is a diagram illustrating the structure of an image forming apparatus including a sheet feeding apparatus according to an embodiment of this disclosure.

Embodiments according to this disclosure will be described with reference to the drawings. FIG. 1 is a section view illustrating the structure of an image forming apparatus according to an embodiment of this disclosure.

[Image Forming Apparatus]

As illustrated in FIG. 1, an image forming apparatus 600 includes an image forming apparatus body (referred to below as an apparatus main body) 600*a* and a sheet feeding deck 100 connected to the apparatus main body 600*a*. The sheet feeding deck 100 as a sheet feeding apparatus is connected to the right side of the apparatus main body 600*a* in FIG. 1.

The apparatus main body 600*a* includes sheet feeding cassettes 909*a* and 909*b* in which normal sheets S are stacked, an image forming portion 603 forming a toner image on a sheet using an electro-photographic process, a fixing unit 904 fixing the toner image formed on the sheet S, and the like. The image forming portion 603 forms an image on the sheet S fed from the sheet feeding deck 100. Above the apparatus main body 600*a*, there are a scanning apparatus 650 including a scanning portion and a document conveying portion and an operating portion 601 operated by a user to make various types of inputs and settings for the apparatus main body 600*a*.

When an image on a document is formed onto a sheet, the image forming apparatus 600 first reads an image on a document conveyed by the document conveying portion of the scanning apparatus 650, using an image sensor of the scanning portion. After that, the read digital data is input to an exposing portion and photoconductive drums 914*a*, 914*b*, 914*c*, and 914*d* provided in the image forming portion 603 are illuminated with light corresponding to the digital data. Such illumination with light forms electrostatic latent images on the surfaces of the photoconductive drums and development of the electrostatic latent images forms toner images in yellow (Y), magenta (M), cyan (C), and black (Bk) on the surfaces of the photoconductive drums.

Next, the above toner images in four colors are transferred to a sheet that is fed by feeding rollers 908 corresponding to the sheet feeding cassettes 909*a* and 909*b* or a feeding roller 101 as the feeding portion corresponding to the sheet feeding deck 100 and then conveyed by a conveyor belt 903. In addition, after the transfer, the toner images transferred to the sheet are heated and fixed by the fixing unit 904.

After the toner images are fixed onto the sheet as described above, when a one side mode for forming images on one side of a sheet is selected, the sheet S is discharged as is outside the machine via a discharging roller pair 907. In contrast, when a both side mode for forming images on both sides of a sheet is selected, the sheet S is passed from the fixing unit 904 to a reverse roller 905 and then the reverse roller 905 is reversed at a predetermined timing. Then, the sheet S is conveyed toward duplex conveyance rollers 906*a*, 906*b*, 906*c*, 906*d*, 906*e*, and 906*f*. After that, the sheet S is conveyed to the image forming portion 603 again and toner images in four colors (yellow, magenta, cyan, and black) are transferred onto its back surface. The sheet S having the back surface onto which the toner images in four colors have been transferred in this way is conveyed to the fixing unit 904 again so that the toner images are fixed and then discharged outside the machine through the discharging roller pair 907.

Figure 2:
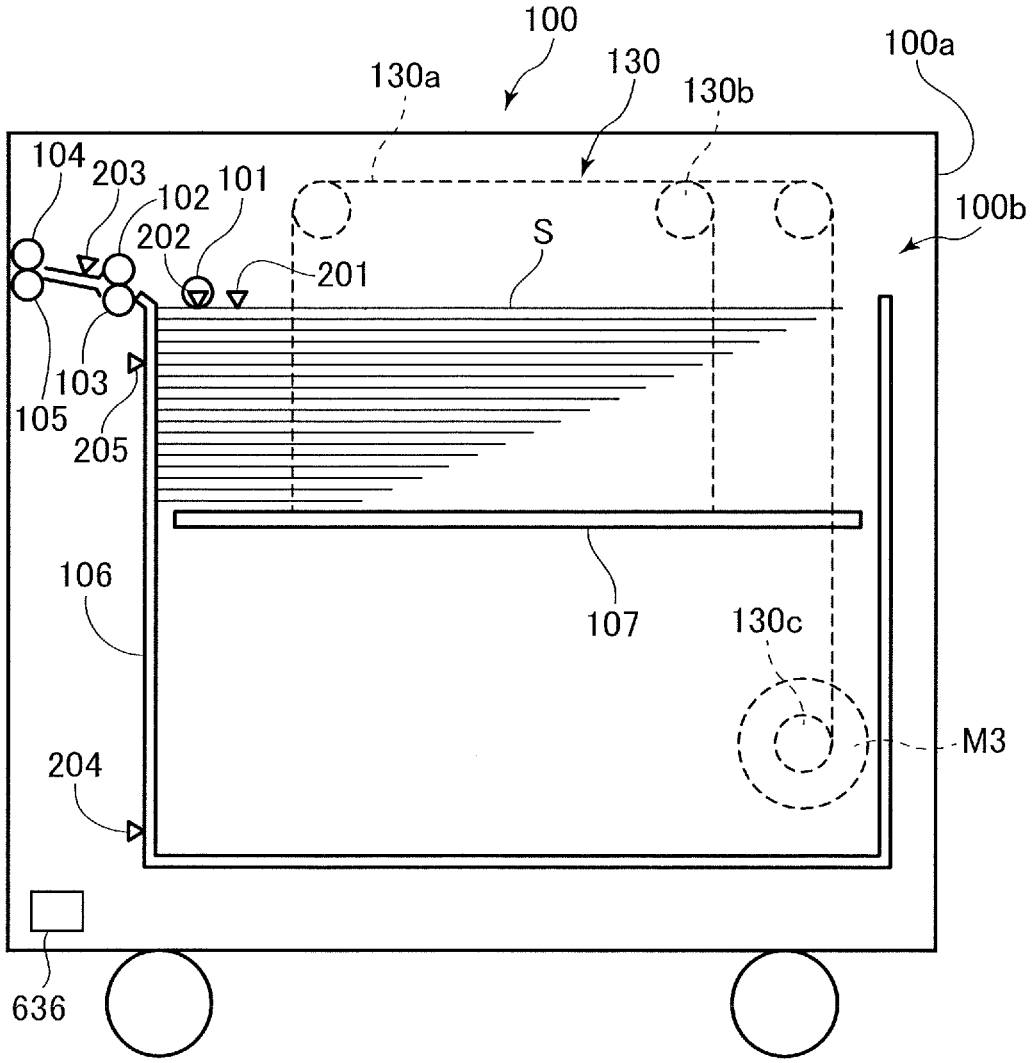
FIG. 2 is a diagram illustrating the structure of a sheet feeding deck as a sheet feeding apparatus.

The sheet feeding deck 100 will be described in detail with reference to FIG. 2. FIG. 2 a schematic section view illustrating the sheet feeding deck 100.

As illustrated in FIG. 2, the sheet feeding deck 100 is a sheet feeding apparatus of large capacity stacking type that can stack, on a lifter tray 107, a larger number of sheets S than the number of sheets S stacked in the sheet feeding cassettes 909*a* and 909*b* of the apparatus main body 600*a* so as to perform continuous feeding. The sheet feeding deck 100 has a deck body 100*a* as a sheet feeding apparatus body. In the deck body 100*a*, a sheet feed unit 100*b* that feeds stacked sheets on a one-by-one basis and a deck control portion 636 that controls the sheet feed unit 100*b* are provided.

The sheet feed unit 100*b* includes a box-shaped storage 106 that stores a large number of sheets S, the lifter tray 107 that is a stacking portion on which sheets S are stacked, the lifter tray 107 being disposed in the storage 106 so as to movable up and down, and the feeding roller 101 that feeds sheets, and an elevating mechanism (lifter mechanism) 130 as a lifting portion. The elevating mechanism 130 elevating or lowering the lifter tray 107 includes a wire 130*a* hanging and supporting the lifter tray 107, a plurality of pulleys 130*b* around which the wire 130*a* is wounded, a wire pulley 130*c* to which the wire 130*a* is joined, and a lifter motor M3 to which the wire pulley 130*c* is connected. The lifter motor M3 rotates the wire pulley 130*c*, the wire 130*a* is wound around the wire pulley 130*c*, and the lifter tray 107 is lifted. The feeding roller 101 is provided in an upper position facing a downstream side in the sheet feeding direction of the sheets S stacked on the lifter tray 107 and feeds the sheets S stacked on the lifter tray 107.

The sheet feed unit 100*b* further includes a feed roller 102 that feeds the fed sheets S to further downstream and a retard roller 103, disposed so as to face the feed roller 102, that separates the sheets S on a one-by-one basis. The sheet S separately conveyed by the feed roller 102 and the retard roller 103 is conveyed to the apparatus main body 600*a* by a pull-out roller pair 104 and 105. It is noted that the above rollers are configured as rubber rollers having an outer peripheral surface around which a member with a high friction coefficient such as rubber is wounded.

For example, when two or more sheets S are fed by the feeding roller 101 and caught in a separation nip portion formed by the feed roller 102 and the retard roller 103, entry of the second and subsequent sheets S is prevented by the retard roller 103. Then, only the first topmost sheet is conveyed toward the pull-out roller pair 104 and 105.

A sheet height detection sensor 202 is disposed in the vicinity of the feeding roller 101. In addition, a sheet presence detection sensor 201 is disposed upstream in the sheet feeding direction of the feeding roller 101. In addition, a feeding sensor 203 is disposed between the pull-out roller pair 104 and 105 and the feed roller 102. A position detection sensor 205 is disposed below the retard roller 103 and a tray lower limit sensor 204 is disposed in a lower part of the storage 106.

[Control System of Image Forming Apparatus]

Figure 3:
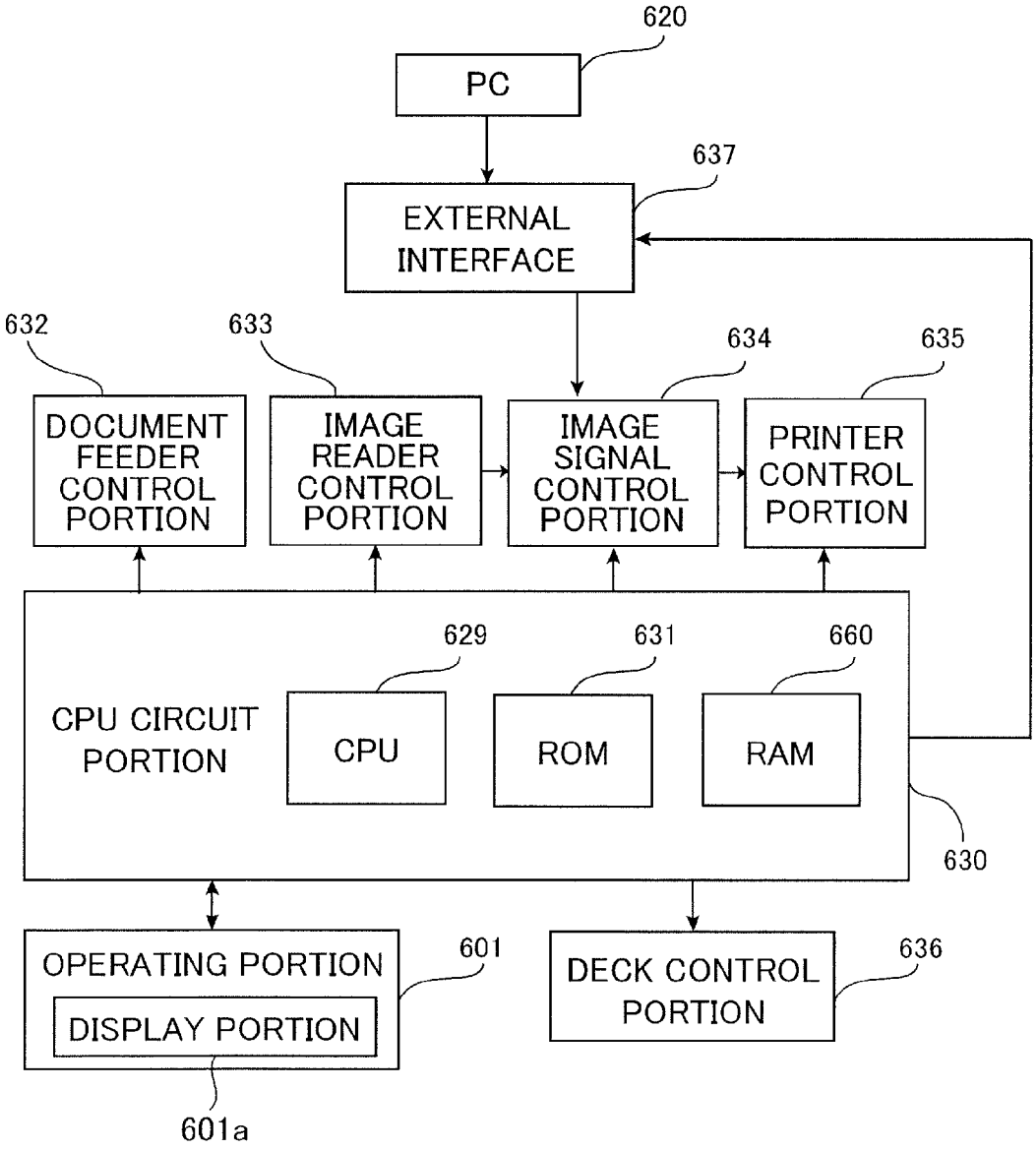
FIG. 3 is a control block diagram illustrating a control system of the image forming apparatus according to the embodiment of this disclosure.

Next, a control system of the image forming apparatus 600 will be described with reference to FIG. 3. FIG. 3 is a block diagram illustrating the control system of the image forming apparatus 600.

As illustrated in FIG. 3, a CPU circuit portion 630 is provided in the apparatus main body 600*a* of the image forming apparatus 600. The CPU circuit portion 630 includes a CPU 629, a ROM 631 containing control programs and so on, and a RAM 660 used as an area for temporarily holding control data or a work area for computation accompanying control.

The image forming apparatus 600 is connected to an external PC (computer) 620 via an external interface 637. Upon receiving print data from the external PC 620, the external interface 637 develops the data into a bit map image and outputs the bit map image to an image signal control portion 634 as image data.

The image signal control portion 634 outputs the image data to a printer control portion 635. The printer control portion 635 outputs the data from the image signal control portion 634 to an exposing control portion (not illustrated). The image of a document read by the image sensor is output from an image reader control portion 633 to the image signal control portion 634 and the image signal control portion 634 outputs the output image to the printer control portion 635.

The operating portion 601 includes a plurality of keys for setting various functions concerning image formation, a display portion (monitor) 601*a* for displaying setting states, and so on. The operating portion 601 outputs, to the CPU circuit portion 630, a signal corresponding to the operation of each key by the user and the like and displays the corresponding information on the display portion 601*a* based on a signal from the CPU circuit portion 630.

According to control programs contained in the ROM 631 and settings input through the operating portion 601, the CPU circuit portion 630 controls the image signal control portion 634 and controls the document conveying portion of the scanning apparatus 650 (see FIG. 1) via the document feeder control portion 632. The CPU circuit portion 630 controls the scanning portion of the scanning apparatus 650 via the image reader control portion 633, controls the image forming portion 603 (see FIG. 1) via the printer control portion 635, and controls the sheet feeding deck 100 via the deck control portion 636.

In the embodiment, the deck control portion 636, which controls the sheet feeding deck 100, is mounted on the deck body 100*a* of the sheet feeding deck 100 and controls the driving of the sheet feeding deck 100 by communicating with the CPU 629 and the like of the CPU circuit portion 630. However, the deck control portion 636 may not be mounted on the deck body 100*a* of the sheet feeding deck 100 and the deck control portion 636 may be placed on the apparatus main body 600*a* side by integrating the deck control portion 636 with the CPU circuit portion 630 such that the sheet feeding deck 100 is directly controlled on the apparatus main body 600*a* side.

Figure 4:
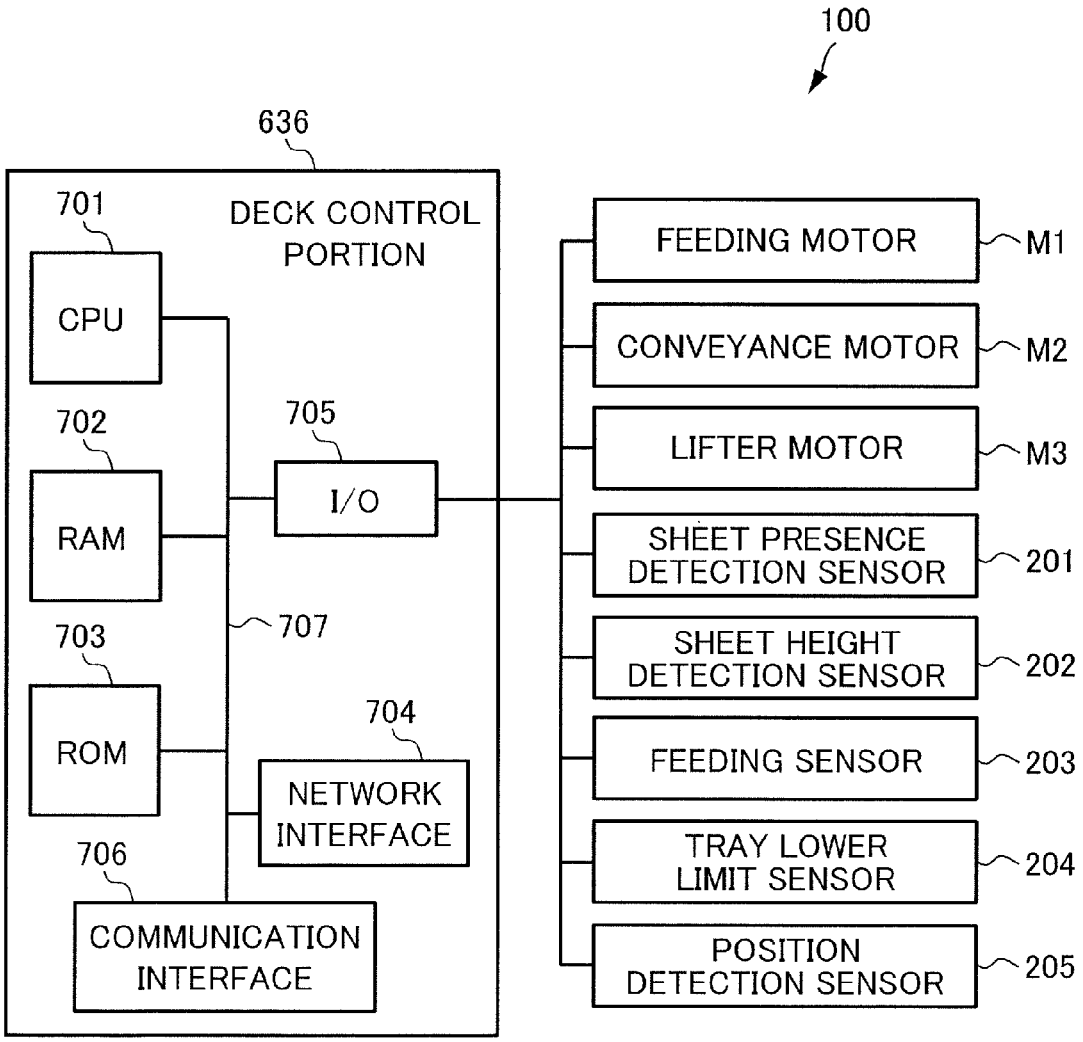
FIG. 4 is a control block diagram illustrating a control system of the sheet feeding deck according to the embodiment of this disclosure.

Next, the structure of the deck control portion 636 will be described with reference to FIGS. 4 and 5. FIG. 4 is a block diagram illustrating the deck control portion 636 and FIG. 5 is a perspective view illustrating a state in which the storage 106 has been pulled out forward from the deck body 100*a* of the sheet feeding deck 100.

Figure 5:
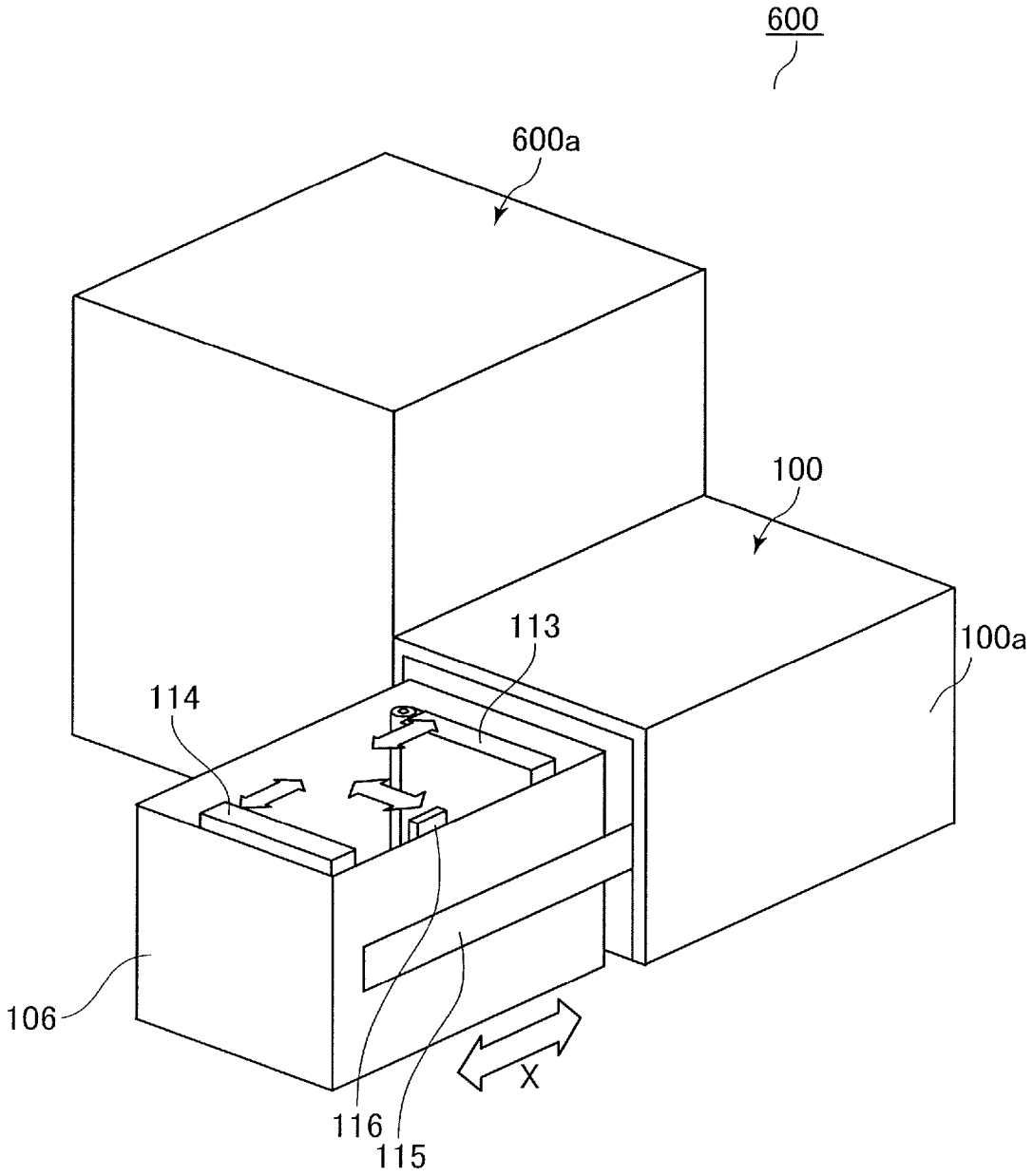
FIG. 5 is a perspective view illustrating the structure and operation of the sheet feeding deck.

As illustrated in FIG. 5, the storage 106 is supported movably in the direction (the forward direction of the drawing sheet in FIGS. 1 and 2) of arrow X by a slide rail 115 provided in the deck body 100*a* of the sheet feeding deck 100. In the storage 106, a far side regulating plate 113, a near side regulating plate 114, and a trailing end regulating plate 116 that guide the side ends of the sheets S are provided. These regulating plates 113, 114, and 116 are supported by the lifter tray 107 so as to be movable manually in the directions of the arrows according to the size of sheets to be set.

The procedure for replenishing the sheet feeding deck 100 with sheets will be described. First, the storage 106 is pulled out from the deck body 100*a*, the sheets S are set on the lifter tray 107 (see FIG. 2), and the regulating plates 113, 114, and 116 are moved so as to be aligned with the ends of the set sheets S. When the storage 106 is closed so as to be housed in the deck body 100*a* again, the deck control portion 636 controls the lifter motor M3 so as to lift the lifter tray 107.

The deck control portion 636 stops the lifter motor M3 when the topmost sheet on the lifter tray 107 reaches an appropriate height at which the topmost sheet is fed by the feeding roller 101. The deck control portion 636 controls the driving and stopping of the lifter motor M3 based on a signal, corresponding to a position of the upper surface of the sheet, that is output from the sheet height detection sensor 202, which will be described later.

As illustrated in FIG. 4, the deck control portion 636 of the sheet feeding deck 100 includes a CPU 701 as a control portion, a RAM 702 used for an area for temporarily holding control data or a work area for computation accompanying control, a ROM 703 containing control programs and so on, a network interface 704, an I/O 705, and a communication interface 706. The CPU 701, the RAM 702, the ROM 703, the network interface 704, the I/O 705, and the communication interface 706 are interconnected by a bus 707.

The feeding motor M1, a conveyance motor M2, the lifter motor M3, the sheet presence detection sensor 201, the sheet height detection sensor 202, the feeding sensor 203, the tray lower limit sensor 204, and the position detection sensor 205 are connected to the I/O 705.

The driving of the feeding motor M1, the conveyance motor M2, and the lifter motor M3 is controlled based on control by the CPU 701. The sheet presence detection sensor 201, the sheet height detection sensor 202, the feeding sensor 203, the tray lower limit sensor 204, and the position detection sensor 205 transmit detection signals to the CPU 701 via the I/O 705.

The feeding motor M1 is driven to rotate the feeding roller 101. The conveyance motor M2 is driven to rotate the feed roller 102, the pull-out roller pair 104 and 105, and the like. The lifter motor M3 provided in the elevating mechanism 130 is driven to elevate or lower the lifter tray 107.

Figure 6:
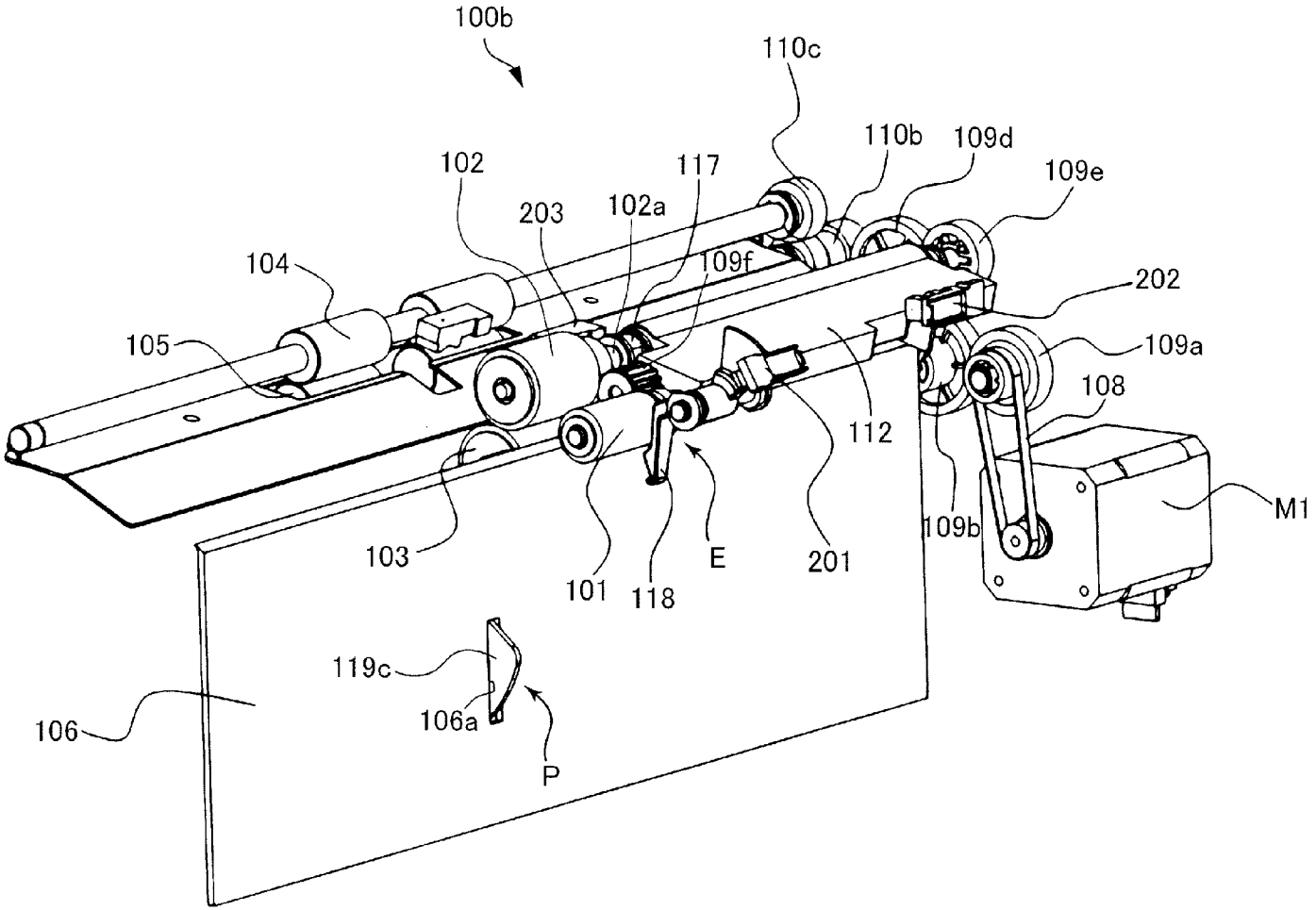
FIG. 6 is a perspective view illustrating the structure of the main part of the sheet feeding deck.
Figure 7A:
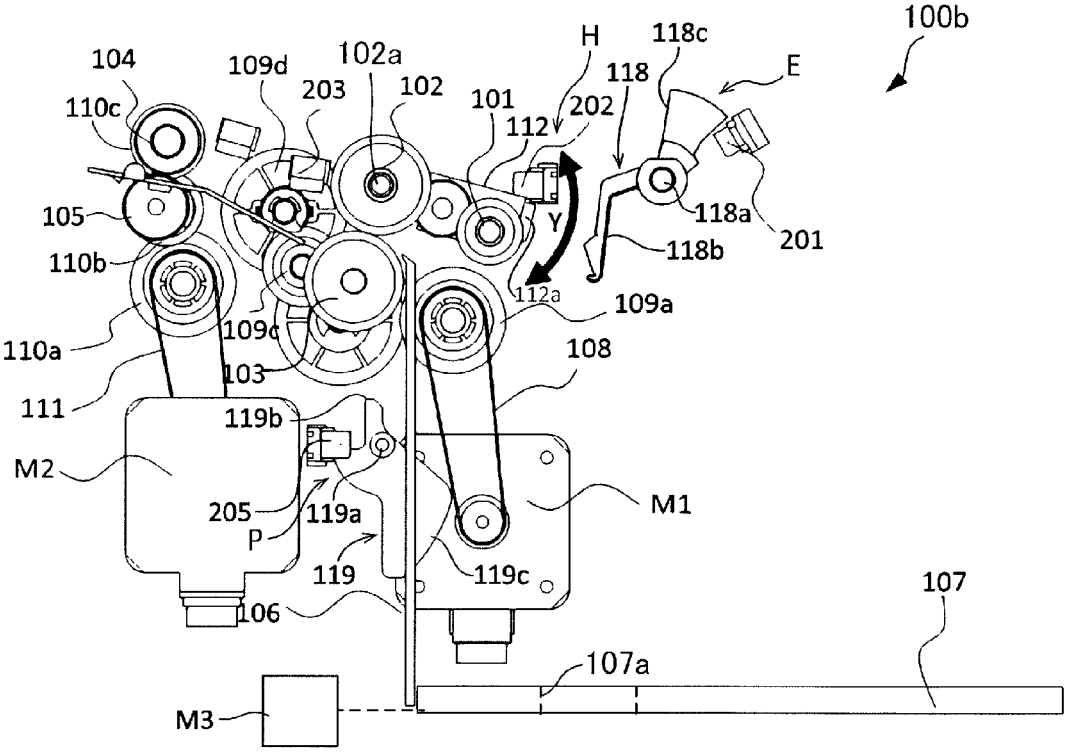
FIG. 7A is a schematic section view illustrating the structure of the main part of the sheet feeding deck.
Figure 7B:
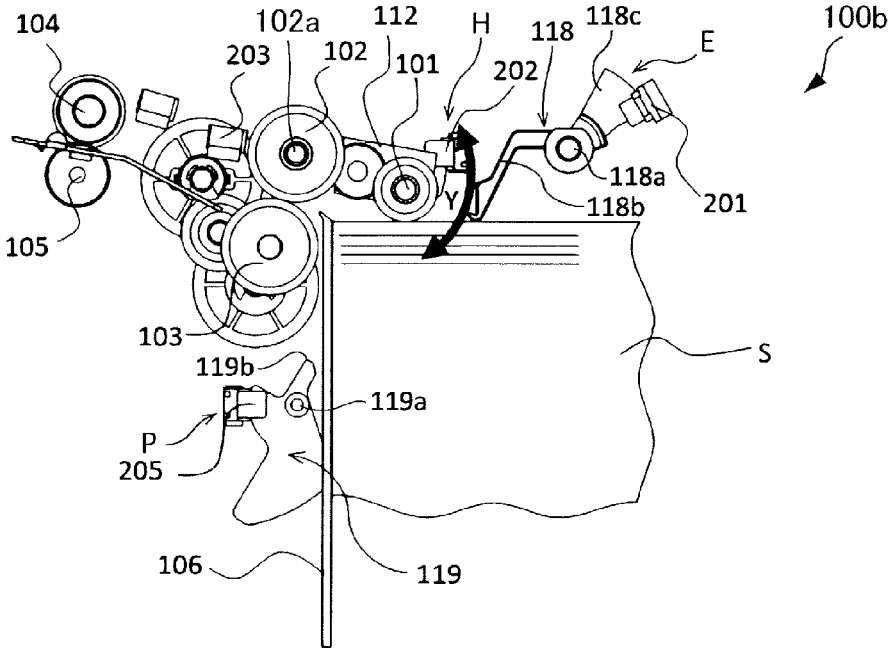
FIG. 7B is a schematic section view illustrating a state in which sheets stacked on a lifter tray abut against a feeding roller.

Here, FIG. 6 is a perspective view illustrating the sheet feed unit 100*b* for feeding sheets on the sheet feeding deck 100 illustrated in FIG. 2 and FIGS. 7A and 7B are partial section views illustrating the sheet feed unit 100*b*.

As illustrated in FIGS. 6, 7A, and 7B, the sheet feed unit 100*b* includes a sheet presence detecting portion E, a sheet height detecting portion H as a first height detecting portion, and a position detecting portion P as a second height detecting portion.

The sheet presence detecting portion E has the sheet presence detection sensor 201 connected to the CPU 701. The sheet presence detection sensor 201 has, for example, a photo-interrupter, which includes a light-emitting portion emitting light and a light-receiving portion outputting an ON signal by receiving the emitted light. The sheet presence detecting portion E further includes a sheet presence detection lever 118 disposed upstream in the sheet feeding direction of the feeding roller 101, the sheet presence detection lever 118 disposed contactably with the upper surface of the sheets S on the lifter tray 107. The sheet presence detection lever 118 pivots by abutting against the upper surface of sheets stacked on the lifter tray 107. The CPU 701 detects presence or absence of the sheets S based on a signal generated by the sheet presence detection sensor 201 depending on the pivotal position of the sheet presence detection lever 118.

In the embodiment, when the sheet presence detection lever 118 does not abut against the upper surface of the sheets S, the light-receiving portion receives the light emitted by the light-emitting portion and the sheet presence detection sensor 201 outputs an ON signal. And when the sheet presence detection lever 118 abuts against the upper surface of the sheets S, a light shielding plate 118*c* of the sheet presence detection lever 118 blocks the light emitted by the light-emitting portion, the light-receiving portion can't receive the light, and the sheet presence detection sensor 201 outputs an OFF signal. The position at which the sheet presence detection lever 118 abuts against the upper surface of the sheets stacked on the lifter tray 107 is upstream in the sheet feeding direction of the position at which the feeding roller 101 abuts against the upper surface of the sheets.

The sheet height detecting portion H includes the sheet height detection sensor 202 connected to the CPU 701, a pivotable roller arm 112 supporting the feeding roller 101, and a light shielding plate 112*a* provided on the roller arm 112. The sheet height detection sensor 202 has, for example, a photo-interrupter, which includes a light-emitting portion emitting light and a light-receiving portion outputting an ON signal by receiving the emitted light. When the lifter tray 107 is elevated or lowered, the roller arm 112 pivots about a rotation shaft 102*a* of the feed roller 102 via the feeding roller 101 that abuts against the stacked sheets S and the sheet height detection sensor 202 outputs a signal corresponding to the rotation position of the roller arm 112. The CPU 701 detects that the upper surface of a sheet bundle stacked on the lifter tray 107 reaches a predetermined height based on the signal from the sheet height detection sensor 202. The sheet height detecting portion H detects the position of the contact portion between the feeding roller 101 and the stacked sheets and the CPU 701 controls the elevating mechanism 130 to lift the lifter tray 107 based on the detection. In the embodiment, when the position in the height direction of the feeding roller 101 is not located in the feed position (within a limit capable of feeding) at which the topmost sheet is fed, the light-receiving portion receives the light emitted by the light-emitting portion and the sheet height detection sensor 202 outputs an ON signal. And when the position in the height direction of the feeding roller 101 is located in the feed position (within a limit capable of feeding), the light shielding plate 112*a* of the roller arm 112 blocks the light emitted by the light-emitting portion, the light-receiving portion can't receive the light, and the sheet height detection sensor 202 outputs an OFF signal. When receiving the OFF signal from the sheet height detection sensor 202, the CPU 701 stops the lifter motor M3 by assuming the position in the height direction of the feeding roller 101 to be present at the position at which the topmost sheet is fed to stop lifting the lifter tray 107. That is, the sheet height detecting portion H outputs a signal corresponding to whether the position in the height direction of the feeding roller 101 is located in a feeding position at which the topmost sheet can be fed. In addition, the feeding sensor 203 outputs a signal depending on whether the front end and the trailing end of the sheet S has passed between the feed roller 102 and the pull-out roller pair 104 and 105.

In the embodiment, the sheet height detection sensor 202 outputs the signal depending on the height of the feeding roller 101. However, this disclosure is not limited to the embodiment and the sheet height detecting portion H may be configured such that the sheet height detection sensor outputs the signal depending on the position of the detection lever directly abutted against the upper surface of the sheet.

The tray lower limit sensor 204 is disposed below the storage 106 to define the lower limit position of the lifter tray 107. As the tray lower limit sensor 204, an appropriate component such as a photo sensor or microswitch may be used. In the embodiment, the tray lower limit sensor 204 has a photo-interrupter, outputs an OFF signal when the lifter tray 107 is located in the lower limit position, and outputs an ON signal when the lifter tray 107 isn't located in the lower limit position. When determining that the OFF signal has been output from the tray lower limit sensor 204 during lowering the lifter tray 107, the CPU 701 stops the lifter motor M3 to stop lowering the lifter tray 107 by assuming that the lifter tray 107 has reached the lower limit position. That is, the CPU 701 stops lowering the lifter tray 107 based on the signal from the tray lower limit sensor 204.

The position detecting portion P includes the position detection sensor 205 and a position detection lever (member) 119 pivoting between a first pivotal position (position in FIG. 7B) and a second pivotal position (position in FIG. 7A) depending on the position of the lifter tray 107 and the height of stacked sheets. Then, the position detection sensor 205 outputs a signal corresponding to the pivotal position of the position detection lever 119. In addition, the position detecting portion P has a twisted coil spring (not illustrated) biasing the position detection lever 119 in the counterclockwise direction in FIG. 7A.

As illustrated in FIG. 6, the feeding roller 101 is supported by the roller arm 112 pivotably attached to the rotation shaft 102*a* of the feed roller 102. The roller arm 112 is supported pivotably in the direction of arrow Y (see FIG. 7A) about the rotation shaft 102*a* of the feed roller 102 and constantly biased by a twisted coil spring 117 (see FIG. 6) in the downward direction (the clockwise direction provided around the rotation shaft 102*a* in FIG. 7A). In the end portion of the roller arm 112, the light shielding plate 112*a* that blocks or transmits light between the light-emitting portion and the light-receiving portion of the sheet height detection sensor 202 is provided so as to face the sheet height detection sensor 202. Since the roller arm 112 is biased by the twisted coil spring 117 such that the feeding roller 101 abuts against the topmost sheet S on the lifter tray 107, the feeding roller 101 can track the elevation and lowering of the upper surface of sheets stacked on the lifter tray 107. The feed roller 102 and the retard roller 103 are given rotation by the feeding motor M1 via a timing belt 108 and spur gears 109*a*, 109*b*, 109*d*, and 109*e*. The feeding roller 101 is given rotation by the rotation shaft 102*a* of the feed roller 102 via a spur gear 109*f* and rotated in the same direction as the feed roller 102.

The feed roller 102 as a conveyance roller is disposed downstream in the sheet feeding direction of the feeding roller 101 and conveys the sheet S fed by the feeding roller 101 toward the apparatus main body 600*a* via the pull-out roller pair 104 and 105. In a predetermined position on the wall of the storage 106, there is an elliptic hole 106*a* into which a protruding portion 119*c* of the position detection lever 119 that pivots according to the elevation and lowering of the lifter tray 107 is inserted. The protruding portion 119*c* may protrude from the elliptic hole 106*a* into the storage 106 and make contact with the side end of the sheet bundle on the lifter tray 107 or the side end of the lifter tray 107.

As illustrated in FIGS. 7A and 7B, the position detection sensor 205 is disposed on the side of the storage 106 and the position detection lever 119 is disposed in a position facing the position detection sensor 205. The position detection sensor 205 and the position detection lever 119 are supported by the deck body 100*a* so as to meet a predetermined positional relationship.

Figure 11A:
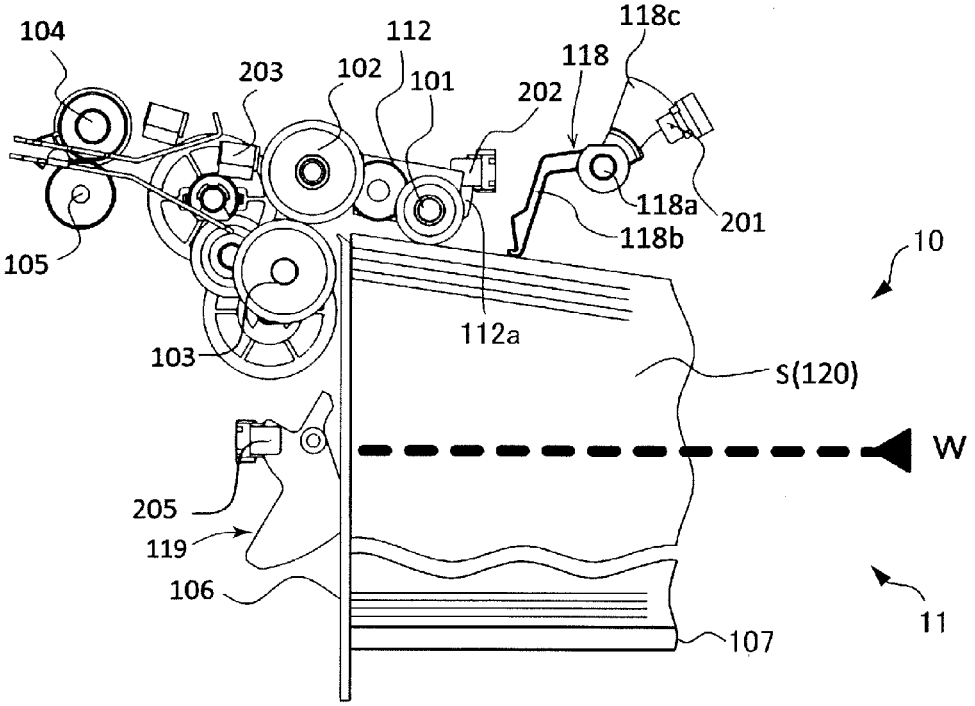
FIG. 11A is a schematic section view illustrating an envelope stacking state in which a large number of envelopes are stacked on the sheet feeding deck.
Figure 11B:
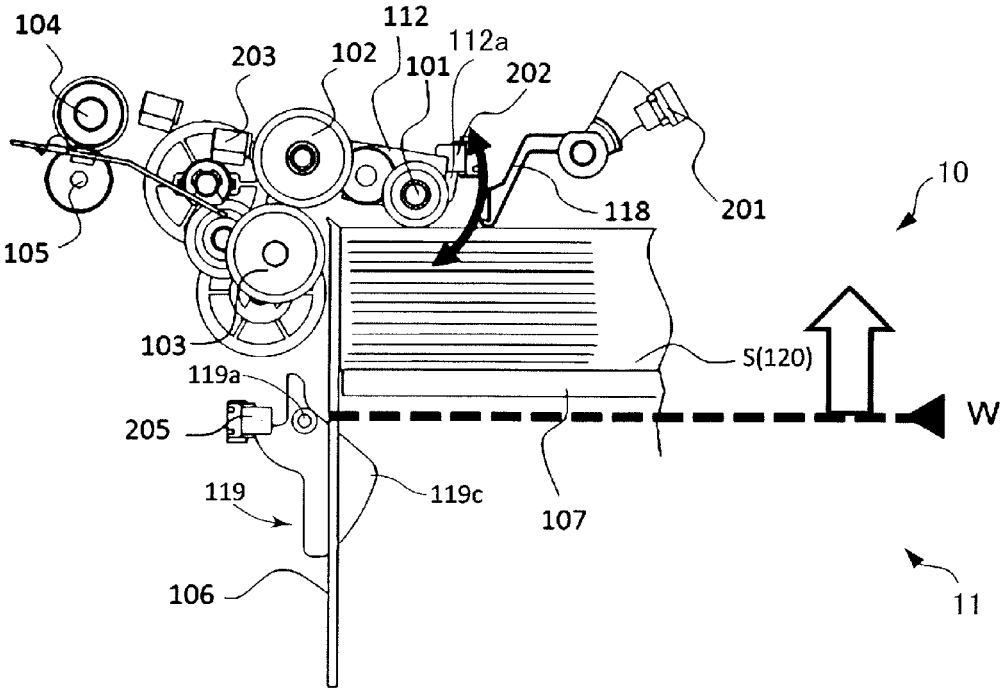
FIG. 11B is a schematic section view illustrating an envelope stacking state in which a small number of envelopes are stacked on the sheet feeding deck.

The position detection lever 119 is pivotably supported by a pivotal shaft 119*a* fixed to the deck body 100*a*, has an abutting projection 119*b* on its top, and has, in the storage 106, the protruding portion 119*c* that may protrude from the elliptic hole 106*a*. The position detection sensor 205 outputs a signal corresponding to the position of the position detection lever 119 pivoting according to the position in the height direction of the lifter tray 107. The position detection sensor 205 has, for example, a photo-interrupter, which includes a light-emitting portion emitting light and a light-receiving portion outputting a signal by receiving the emitted light. As illustrated in FIG. 11A, when the lifter tray 107 is located in a first region 11 below a position (position W) with the same level as the height of the detection position of the position detection sensor 205, the position detection lever 119 blocks the light emitted by the light-emitting portion, the light-receiving portion can't receive the light. Accordingly, the position detection sensor 205 outputs an OFF signal. And as illustrated in FIG. 11B, when the lifter tray 107 is located in a second region 10 above the position W, the light-receiving portion can receive the light emitted by the light-emitting portion and the position detection sensor 205 outputs an ON signal. The CPU 701 detects that the lifter tray 107 is located in the first region 11 below the position W (illustrated in FIG. 11A) or is located in the second region 10 above the position W (illustrated in FIG. 11B) based on detecting by the position detection sensor 205 as described above. It is noted that this disclosure is not limited that the position detection sensor 205 has the photo-interrupter and the position detection sensor 205 may have a reflective optical sensor emitting a light to a side of the lifter tray 107 and detecting a position of the lifter tray 107 based on a light reflected by the lifter tray 107.

When receiving the OFF signal from the position detection sensor 205 during lifting of the lifter tray 107, the CPU 701 determines that the lifter tray 107 on which the sheets have been stacked is located in the first region 11 below position W. And when the lifter tray 107 is located in the first region 11, the CPU 701 stops the sheet presence detecting portion E detecting or doesn't refer a detection of the sheet presence detecting portion E by disabling detection of the sheet presence detecting portion E. Then the CPU 701 controls elevating the lifter tray 107 and feeding a sheet based on detecting by the sheet height detection sensor 202.

When receiving the ON signal from the position detection sensor 205 during lifting of the lifter tray 107, the CPU 701 determines that the lifter tray 107 on which the sheets have been stacked is located in the second region 10 above position W. And the CPU 701 controls for elevating the lifter tray 107 and feeding a sheet based on detecting by the sheet presence detecting portion E and detects presence or absence of sheets. The position detecting portion P stops the sheet presence detecting portion E detecting or outputs a signal corresponding to whether the position in the height direction of the lifter tray 107 located in the first region 11 in which detection by the sheet presence detecting portion E is disabled or the second region 10 in which detection by the sheet presence detecting portion E is enabled as described above.

Figure 9A:
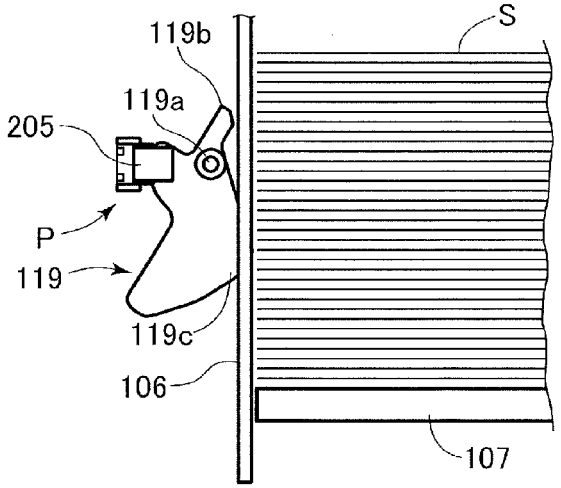
FIG. 9A is a schematic section view illustrating the detection of the sheet height of the sheet feeding deck on which many sheets are stacked.

FIG. 9A illustrates a state in which a large number of the sheets S are set on the lifter tray 107 and the sheets S are ready to be fed or are being fed. In the case, the position detection lever 119 pivots about the pivotal shaft 119*a* in the clockwise direction in this drawing when the protruding portion 119*c* is pushed by the side end surface of the sheet bundle, and blocks light between the light-emitting portion and the light-receiving portion of the position detection sensor 205. Accordingly, the CPU 701 detects that the sheets S are present on the lifter tray 107 based on the signal from the position detection sensor 205.

Figure 9B:
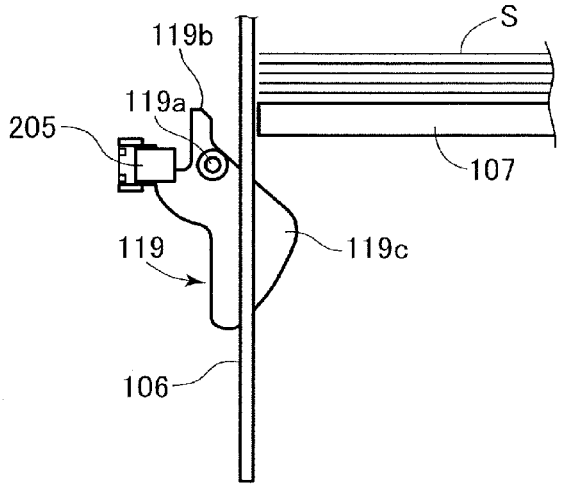
FIG. 9B is a schematic section view illustrating the detection of the sheet height of the sheet feeding deck on which a small number of sheets are stacked.

In this state, when the sheets S are fed by the feeding roller 101 sequentially from the topmost sheet S, the elevating mechanism 130 lifts the lifter tray 107 gradually as the stacked sheets S are reduced. When the lower end portion of the lifter tray 107 passes the position detection lever 119 as illustrated in FIG. 9B, the protruding portion 119*c* of the position detection lever 119 puts in a free state. Then, a biasing force by the twisted coil spring (not illustrated) pivots the position detection lever 119 about the pivotal shaft 119*a* in the counterclockwise direction in the drawing to transmit light between the light-emitting portion and the light-receiving portion of the position detection sensor 205. Accordingly, the CPU 701 detects that the current height position of the lifter tray 107 is at least higher than that of the position detection lever 119 based on the signal from the position detection sensor 205.

Figure 9C:
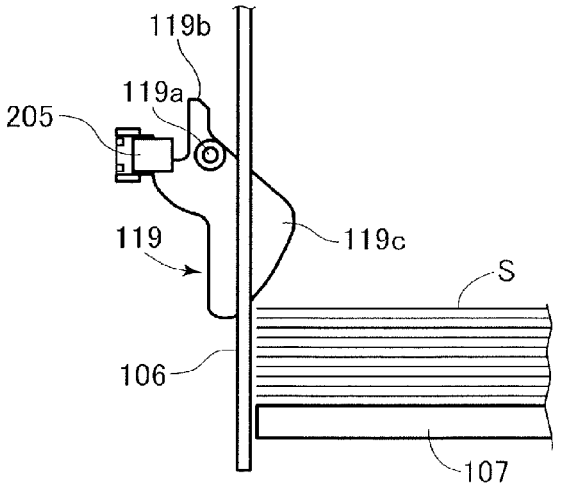
FIG. 9C is a schematic section view illustrating the sheet feeding deck in a state in which the lifter tray has been lowered until a position detection sensor does not detect stacked sheets.

When the user pulls out the storage 106 forward as illustrated in FIG. 5 to set the sheets S, the lifter tray 107 is lowered (state illustrated in FIG. 9C). That is, when the storage 106 is pulled out, the elevating mechanism 130 is controlled so as to lower the lifter tray 107 until the upper surface position of the stacked sheets passes the position detection lever 119 and the position detection sensor 205 enters the transmission state. According to this control, each time a sheet bundle is replenished on the lifter tray 107, the lifter tray 107 is lowered the upper surface of the replenished sheet bundle reaches the same position. Accordingly, one pack of packaged sheets can be placed on the upper surface of the sheet bundle with the same height, thereby improving the workability for setting a sheet bundle in the storage 106. When receiving the signal from the tray lower limit sensor 204 while the lifter tray 107 is lowered after the sheet bundle is set, the CPU 701 stops the lifter tray 107. At this time, the sheets S are fully stacked on the lifter tray 107.

When the storage 106 is pushed and attached to the deck body 100*a* after the sheets S is set, the lifter tray 107 is lifted and, when the topmost sheet is detected by the sheet height detection sensor 202, the movement of the lifter tray 107 stops. When the rotational driving by the feeding motor M1 is transferred to the feeding roller 101, the feed roller 102, and the retard roller 103 in this state, sheets are fed.

Figure 8A:
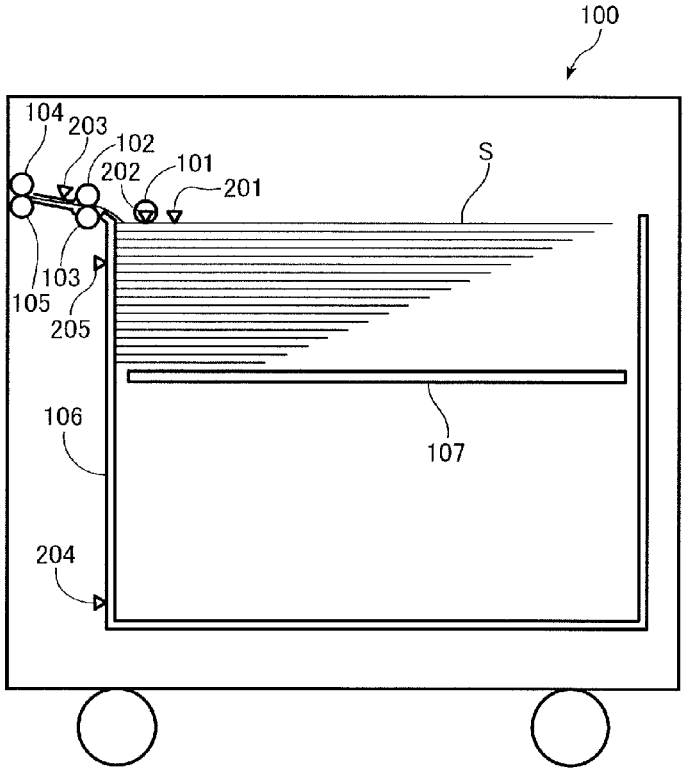
FIG. 8A is a schematic section view illustrating the operation of the lifter tray of the sheet feeding deck on which sheets are stacked.
Figure 8B:
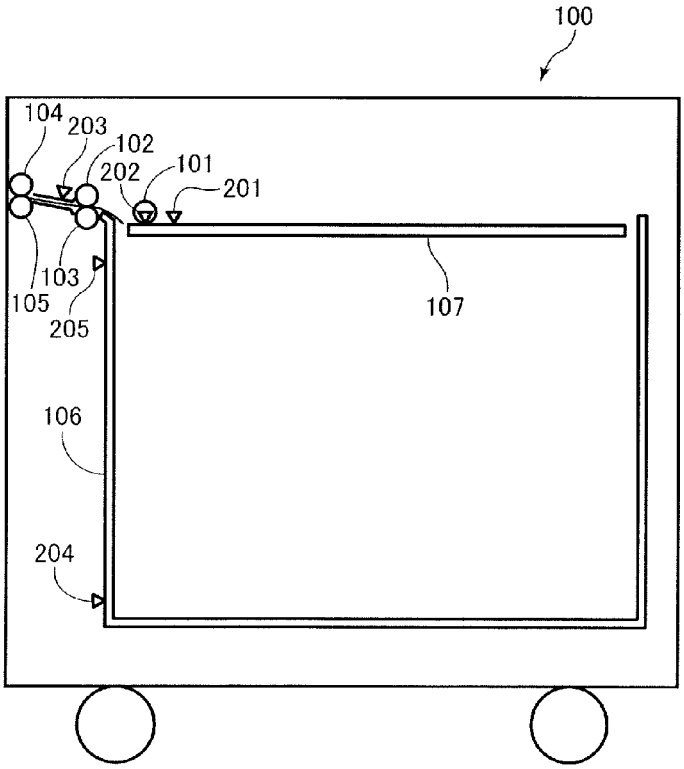
FIG. 8B is a schematic section view illustrating the operation of the lifter tray of the sheet feeding deck on which no sheets are stacked.

When the topmost sheet S is fed sequentially by the feeding roller 101 and the height of the topmost sheet S is lowered as illustrated in FIG. 8A, the feeding roller 101 abutting against the topmost sheet S is pivoted downward. When the feeding roller 101 is lowered as the sheets are reduced, the lifting of the lifter tray 107 is controlled based on the sheet height detection sensor 202 such that the height of the topmost sheet S constantly falls within the range (certain range) in which sheets can be fed. The control will be described in detail later.

Figure 12:
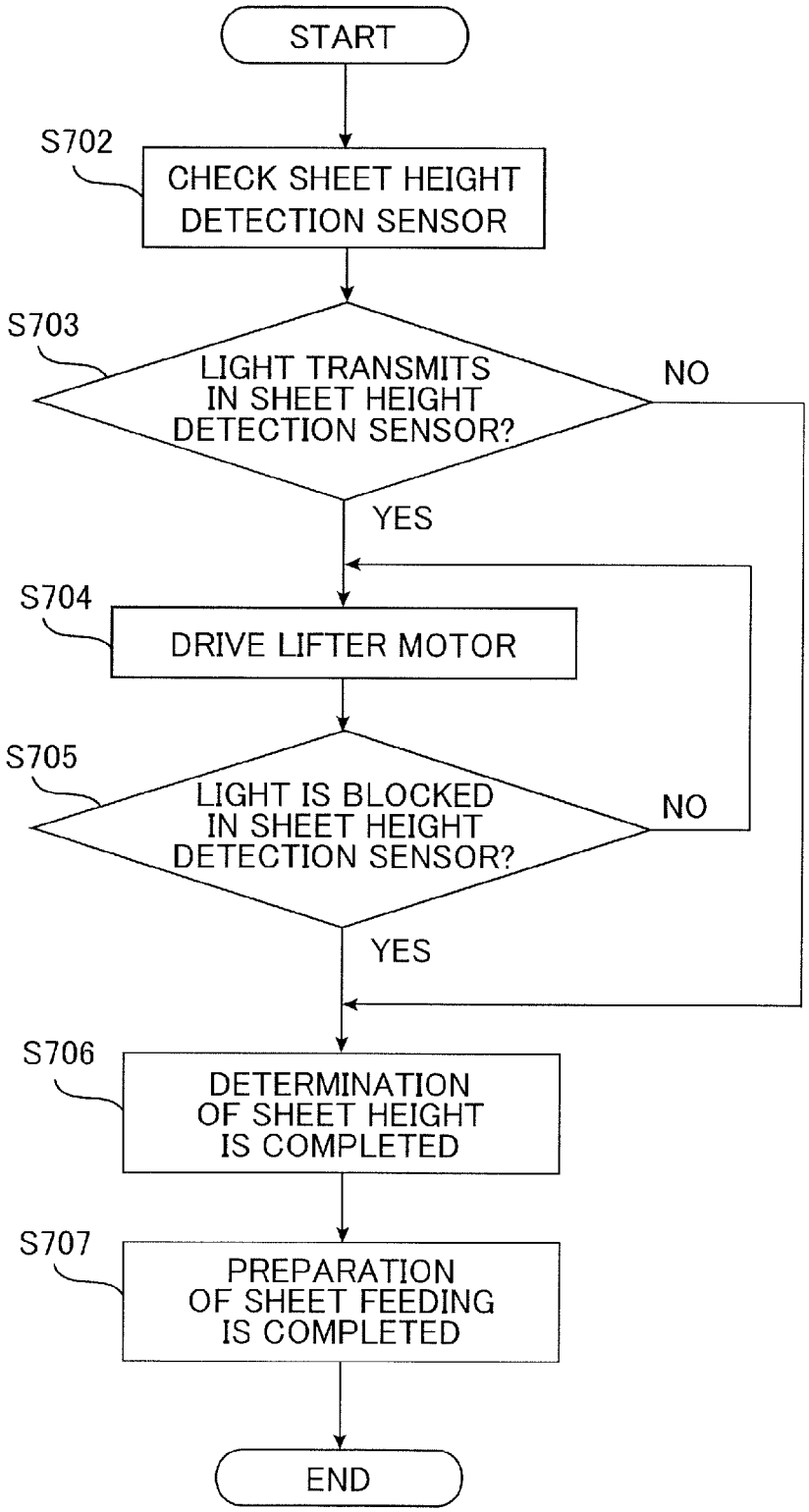
FIG. 12 is a flowchart illustrating the detection of the sheet height of the sheet feeding deck.

The sheet feeding operation of the sheet feeding deck 100 will be described with reference to FIG. 12. FIG. 12 is a flowchart illustrating sheet height determination processing for locating the upper surface of a sheet bundle on the lifter tray 107 at a predetermined height at which sheet feeding is enabled.

In step S702, the CPU 701 checks the detection signal from the sheet height detection sensor 202. Then, in step S703, a determination is made as to whether light is transmitted between the light-emitting portion and the light-receiving portion of the sheet height detection sensor 202.

As a result, if it is determined that light is transmitted, the lifter motor M3 is driven to lift the lifter tray 107 in step S704 and a determination is made as to whether light is blocked by the light shielding plate 112*a* between the light-emitting portion and the light-receiving portion of the sheet height detection sensor 202 in step S705. As a result, if it is determined that light is blocked, the driving of the lifter motor M3 is stopped in step S706 to stop the lifter tray 107 and the sheet height is determined. Accordingly, the topmost position of the sheet bundle on the lifter tray 107 is located at the position at which sheet feeding is enabled and the preparation of sheet feeding is completed (step S707).

Based on a sheet feeding start signal from the CPU circuit portion 630 of the image forming apparatus 600, the deck control portion 636 controls the sheet feed unit 100*b* so as to rotate the feeding roller 101 and feed sheets. With this operation, the pull-out roller pair 104 and 105 transfers the driving by the conveyance motor M2 via a timing belt 111 (FIG. 7A) and the spur gears 110*a* to 110*c* (FIG. 7A). This causes the pull-out roller pair 104 and 105 to convey the sheets S fed by the feeding roller 101 to the apparatus main body 600*a*.

The feeding sensor 203 (see FIG. 7A) of optical axis transmission reflection detection type detects whether the front end and the trailing end of the sheet conveyed by the feeding roller 101, the feed roller 102, and the retard roller 103 pass within a predetermined time from the start of driving. If the end portion of the sheet S does not reach or pass within the predetermined time, the signal from the feeding sensor 203 is sent to the CPU 701 and the display portion 601*a* of the operating portion 601 indicates sheet jam.

As illustrated in FIGS. 7A and 7B, the sheet presence detection lever 118 has a contact portion 118*b* capable of abutting against the topmost sheet S and is disposed upstream in the sheet feeding direction of the feeding roller 101. The sheet presence detection sensor 201 outputs an ON/OFF signal based on whether light is transmitted or blocked by a light shielding plate 118*c* that pivots depending on the pivot about a pivotal shaft 118*a* of the sheet presence detection lever 118 between the light-emitting portion and the light-receiving portion.

The sheet presence detection sensor 201 outputs the ON or OFF signal based on contact or noncontact of the contact portion (distal end portion) 118*b* with the sheet S on the lifter tray 107 in a state in which the sheet presence detection lever 118 is pivotably supported by the deck body 100*a*. In the sheet presence detection lever 118, when the last sheet S on the lifter tray 107 is fed, the contact portion 118*b* is dropped in a hole portion 107*a* formed in a position facing the contact portion 118*b* of the lifter tray 107.

This causes the sheet presence detection lever 118 to pivot in the counterclockwise direction in FIG. 7A using the pivotal shaft 118*a* as a supporting point and the light shielding plate 118*c* moves away from the sheet presence detection sensor 201. That is, when the sheets S on the lifter tray 107 are absent, the sheet presence detection lever 118 pivots in the counterclockwise direction about the pivotal shaft 118*a* and the light shielding plate 118*c* between the light-emitting portion and the light-receiving portion of the sheet presence detection sensor 201 moves away to transmit light. At this time, as the feeding roller 101 abuts against an upper surface of the lifter tray 107, the light is blocked by the light shielding plate 112*a* between the light-emitting portion and the light-receiving portion of the sheet height detection sensor 202. Accordingly, the CPU 701 detects that there is no sheets on the lifter tray 107 based on detecting the ON signal output from the sheet presence detection sensor 201 and the OFF signal output from the sheet height detection sensor 202. That is, when receiving the ON signal output from the sheet presence detection sensor 201, if the sheet height detection sensor 202 outputs the OFF signal, the CPU 701 detects that there is no sheets on the lifter tray 107. This is for preventing the CPU 701 detecting that there is no sheets based on the ON signal output from the sheet presence detection sensor 201 only, because the ON signal is output from the sheet presence detection sensor 201 in a state in which sheets are stacked on the lifter tray 107, when the sheets are set the lifter tray 107 located at the lower limit position. Accordingly, based on detecting the OFF signal output from the sheet height detection sensor 202, it can be determined that the contact portion 118*b* of the sheet presence detection lever 118 is dropped in a hole portion 107*a* in a state in which the lifter tray 107 is lifted.

As described above, when no sheets are stacked on the lifter tray 107, the CPU 701 displays "NO SHEET" on the display portion 601*a* of the operating portion 601 based on detecting the ON signal output from the sheet presence detection sensor 201 and the OFF signal output from the sheet height detection sensor 202. Moreover, the CPU 701 stops feed of sheets by a feed unit of the sheet feed unit 100*b*. In addition, image formation processing is stopped by the image signal control portion 634 (FIG. 3).

Here, a large variety of sheets such as standard cut sheets, envelopes with a turnup flap, emboss sheets with an uneven surface, sheets with a tab, preprinted sheets can be set and fed on the sheet feeding deck 100.

Figure 10:
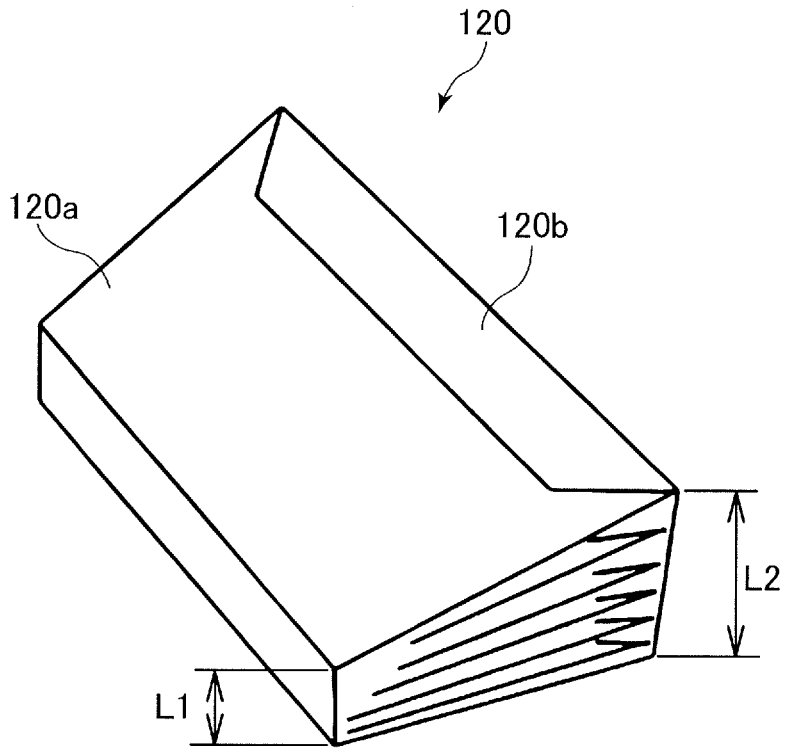
FIG. 10 is a perspective view illustrating a state in which a plurality of envelopes are stacked.

For example, it is assumed that a large number of envelopes 120 as illustrated in FIG. 10 are aligned and stacked on the lifter tray 107, the following process is performed. Since the region of a turnup flap 120*b* and the bag portion 120*a* of the envelope 120 have different heights, the relationship between a height L2 of the turnup flaps 120*b* of a bundle of the stacked envelopes 120 and a height L1 of the bag portion 120*a* is represented by L2>L1. That is, as the number of the envelope 120 to be stacked increases, the height difference between L1 and L2 increase proportionally. When a large number of the envelopes 120 are set on the lifter tray 107, the topmost sheet to be fed becomes inclined.

FIG. 11A is a section view illustrating a state in which the envelopes 120 are set on the lifter tray 107 of the sheet feeding deck 100 with the flaps 120*b* located downstream in the sheet feeding direction. As illustrated in FIG. 11A, the topmost surface of the many stacked envelopes 120 is inclined in the direction in which the upstream side is lowered. The position of the sheets detected by the sheet height detecting portion H that aligns the position of the upper surface of the sheets with a predetermined height is the height position of a portion in which the feeding roller 101 abuts against the sheets and the portion in which the sheet presence detection lever 118 abuts against the sheets is disposed upstream of this abutment portion.

Accordingly, in the state in which movement is stopped based on the detection by the sheet height detection sensor 202, the sheet presence detection lever 118 normally should abut against the topmost envelope 120. However, the sheet presence detection lever 118 may not abut the contact portion 118*b* against the topmost envelope 120 because the height of the envelopes 120 is inclined and the upstream side is lowered. In the case, since the light shielding plate 118*c* can't block between the light-emitting portion and the light-receiving portion of the sheet presence detection sensor 201, the ON signal is input to the CPU 701 from the sheet presence detection sensor 201. Based on the ON signal from the sheet presence detection sensor 201, the CPU 701 displays "NO SHEET" on the display portion 601*a* of the operating portion 601 even though the envelope 120 is stacked on the lifter tray 107 and stops feeding the envelope 120. In this case, it is noted that the OFF signal is input to the CPU 701 from the sheet height detection sensor 202, because the feeding roller 101 abuts against the upper surface of the lifter tray 107.

In the embodiment, when a large variety of sheets such as the envelopes 120, emboss sheets with an uneven surface, sheets with a tab, and preprinted sheets are stacked and fed on the lifter tray 107, a detection signal from the position detection sensor 205 is used. That is, when the lifter tray 107 is located above a position (position W) with the same level as the height of the detection position of the position detection sensor 205 as illustrated in FIG. 11B, the CPU 701 receives the signal from the sheet presence detection sensor 201 and displays presence or absence of sheets on the display portion 601*a* of the operating portion 601. That is, when light is transmitted between the light-emitting portion and the light-receiving portion of the position detection sensor 205, the CPU 701 displays "NO SHEET" on the display portion 601*a* of the operating portion 601 based on the ON signal from the sheet presence detection sensor 201.

When the lifter tray 107 on which sheets have been stacked is located below the position W as illustrated in FIG. 11A (that is, the position detection sensor 205 is in the light shielding state), the CPU 701 performs the following processing. That is, even when receiving, from the sheet presence detection sensor 201, the signal indicating that light is transmitted, the CPU 701 does not display "NO SHEET" on the display portion 601*a* of the operating portion 601. In addition, the CPU 701 does not stop sheet feeding operation. It is noted that, when the position detection sensor 205 is in a light shielding state, the CPU 701 may prevent the sheet presence detection sensor 201 detecting or may not receive the signal from the sheet presence detection sensor 201. Accordingly, when the CPU 701 receives the signal from the sheet presence detection sensor 201, the CPU 701 may disable the signal. That is, as described above, when the position detection sensor 205 is in a light shielding state (the lifter tray 107 is located in the first region 11), the CPU 701 doesn't use the detect of the sheet presence detection sensor 201. When the height position of the lifter tray 107 is lower than the predetermined height (position W) based on detection by the position detection sensor 205, the CPU 701 displays "SHEET PRESENT" on the display portion 601*a* of the operating portion 601.

That is, in a state in which sheets are continuously fed, the CPU 701 makes control so as to keep the positional relationship between the feeding roller 101 and topmost sheet constant by operating the lifter motor M3 as the upper surface of the sheets is lowered. In this case, after the height position of the lifter tray 107 detected by the position detection sensor 205 exceeds the predetermined height (position W), the CPU 701 displays "NO SHEET" on the display portion 601*a* of the operating portion 601 based on the signal from the sheet presence detection sensor 201. That is, when the height position of the lifter tray 107 is higher than the predetermined height (position W) based on detection by the position detection sensor 205, the CPU 701 enables displaying of "NO SHEET" on the display portion 601*a* of the operating portion 601 based on the signal from the sheet presence detection sensor 201.

The predetermined height (position W) is set to a position at which the detection sensor 201 can detect the position of the upper surface of sheets and the sheet presence detection lever 118 of the sheet presence detection sensor 201 can surely abut against the upper surface of the sheet bundle. That is, as long as the lifter tray 107 is above the predetermined height, the sheet presence detecting portion E is capable of detecting the topmost sheet in a state in which the feeding roller 101 abuts against the inclined topmost sheet and is able to feed the sheet. This predetermined height is set by an experiment or the like. That is, in a state in which the tray 107 is located in a position higher than the predetermined height (position W), since the number of stacked sheets in the sheet bundle is significantly smaller than in the full load state, the inclination of the upper surface of the sheet bundle is small and the inclination of the upper surface of the sheet bundle becomes smaller as the sheet bundle is reduced. Accordingly, the predetermined height (position W) only needs to be set to a position higher than the lowest height at which the sheet presence detection lever 118 can abut against the upper surface of sheets. Since sheets are surely stacked when the position of the lifter tray 107 is lower than the predetermined height (position W), there is no need to detect presence or absence of sheets.

In the embodiment, it is noted that the CPU 701 detects the height position of the lifter tray 107 with the position detection sensor 205 used during replenishment of sheets and, based on the result of the detection, the CPU 701 selects whether to display "NO SHEET". However, this disclosure is not limited to this structure and it is also possible to dispose a special sensor at the predetermined height (position W) and select whether to display "NO SHEET" based on the detection of the special sensor, instead of detecting the height position by the position detection sensor 205.

Figure 14:
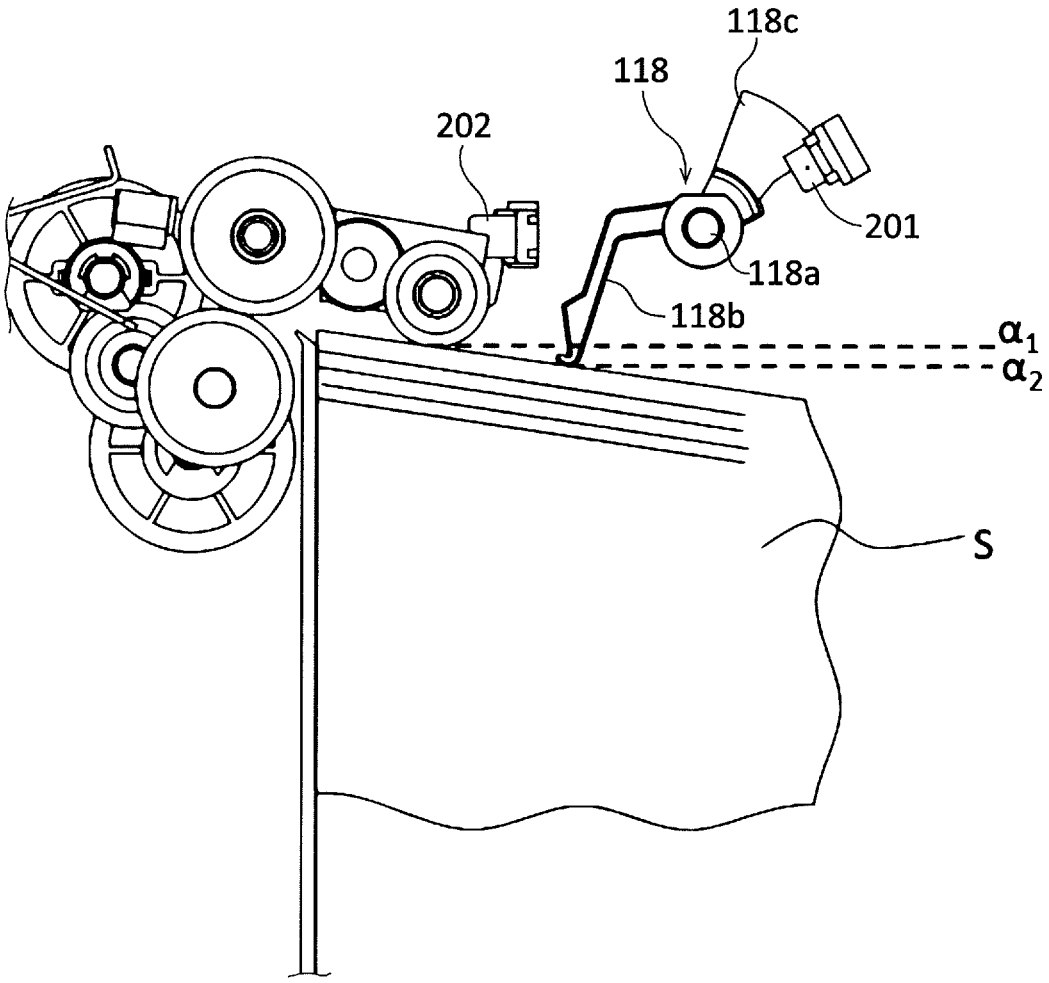
FIG. 14 is a schematic section view illustrating the height difference of detection positions on the upper surface of sheets.

Since the predetermined height (position W) is also determined by the spacing between the sheet height detection sensor 202 and the sheet presence detection sensor 201, the position of the position W can be set appropriately if the special sensor is used. That is, since the height difference (distance between $\alpha_1$ and $\alpha_2$ in FIG. 14) between detection positions increases as the spacing between the sheet height detection sensor 202 and the sheet presence detection sensor 201 is larger, position W is set to a higher position and the sheet presence detection sensor 201 is checked at a position at which the number of stacked sheets is smaller. In contrast, as the spacing between the sheet height detection sensor 202 and the sheet presence detection sensor 201 is smaller, position W is set to a lower position. In order to accurately detect presence or absence of the lowermost sheet on the lifter tray 107, position W is preferably set to a higher position.

Here, sheet presence detection in the sheet feeding deck 100 will be described with reference to FIG. 13.

Figure 13:
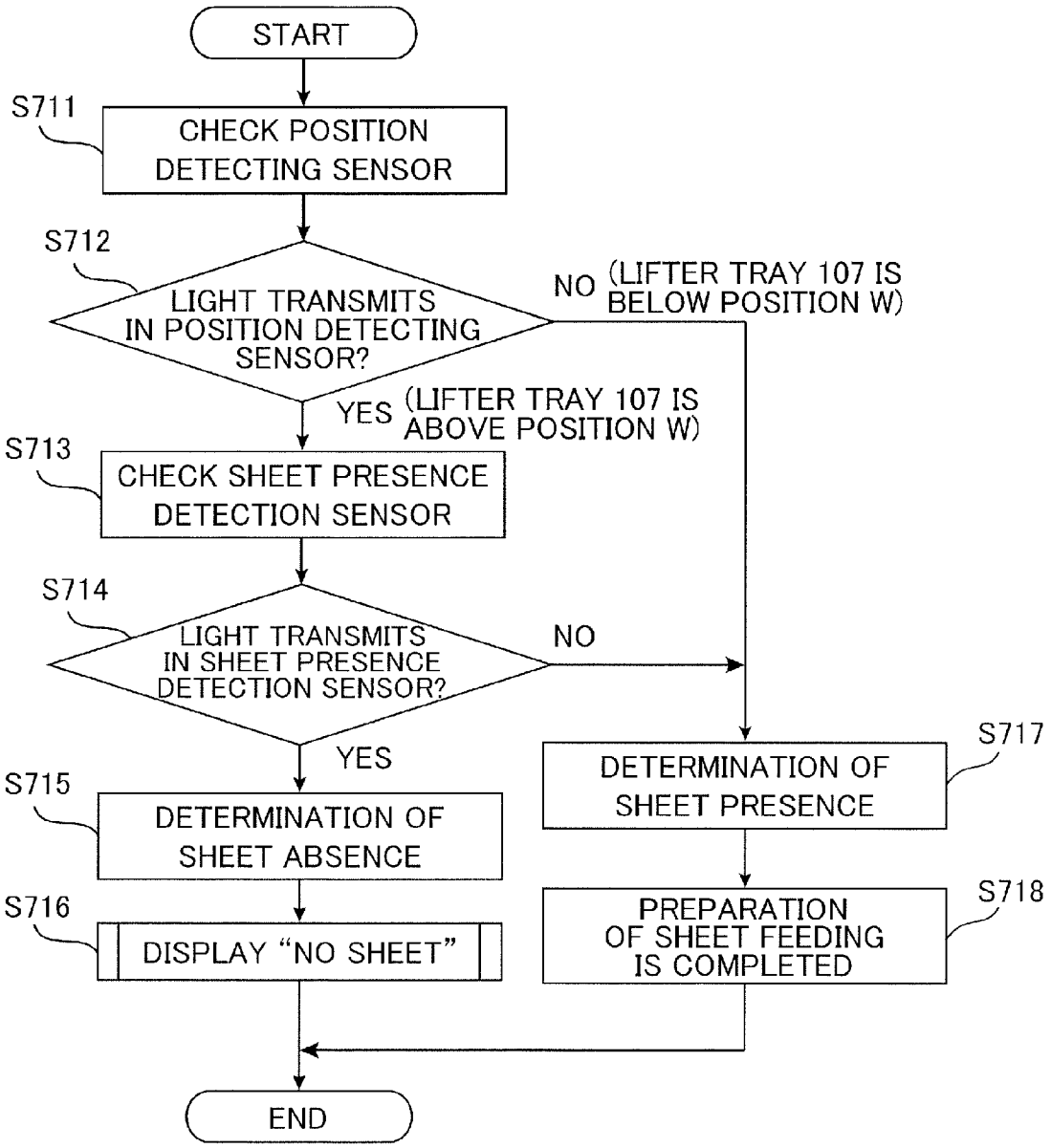
FIG. 13 is a flowchart illustrating the detection of the presence or absence of sheets on the sheet feeding deck.

That is, as illustrated in FIG. 13, the CPU 701 checks in step S711 the detection signal from the position detection sensor 205 to detect the height position of the tray in order to perform sheet presence determination processing. Then, in step S712, a determination is made as to whether light is transmitted between the light-emitting portion and the light-receiving portion of the position detection sensor 205.

As a result, if it is determined that light is transmitted, it is indicated that the lifter tray 107 is located in a position above position W illustrated in FIG. 11B and the processing proceeds to a flow for checking a detection signal from the sheet presence detection sensor 201 in step S713. In a determination flow in step S714, a determination is made as to whether light is transmitted between the light-emitting portion and the light-receiving portion of the sheet presence detection sensor 201. As a result, if it is determined that light is transmitted, it is determined that there are no sheets in step S715, "NO SHEET (NO PAPER)" is displayed on the display portion 601*a* of the operating portion 601 in step S716, and the processing ends.

In contrast, it is detected in step S712 that light is not transmitted between the light-emitting portion and the light-receiving portion of the position detection sensor 205 (that is, light is blocked) or detected in step S714 that light is not transmitted between the light-emitting portion and the light-receiving portion of the sheet presence detection sensor 201, the following processing is performed. That is, it is indicated that sheets are still present on the lifter tray 107 in this case and the following processing is performed. In step S717, presence of sheets is determined. In step S718, preparation of sheet feeding is completed when sheet feeding is not performed yet or sheet feeding is continued when sheet feeding is being performed.

As described above, in the sheet feeding deck 100 according to the embodiment, many sheets of a non-uniform thickness such as envelopes may be stacked on the sheet feeding deck 100 of a large capacity as generally-used cut sheets of a uniform thickness to enable continuous and smooth feeding.

An example of a case in which the envelopes 120 are set has been described above. However, even in the case of emboss sheets, preprinted sheets, punched sheets, and the like, when a large number of such sheets are stacked on the lifter tray 107, the upper surface of the topmost sheet becomes inclined due to the unevenness, toner layer, or ink layer on the surface of the sheets, burrs in a punched end portion, or the like, as in envelopes. However, according to the embodiment, even when emboss sheets or the like are fed instead of the envelopes 120, the same effects as in the envelopes 120 can be obtained.

That is, in the embodiment, even if the upper surface of topmost sheet is inclined and a height difference arises when a large number of the envelopes 120, emboss sheets, or preprinted sheets are stacked on the lifter tray 107, the sheet presence detection is not performed while the large height difference is caused by a large number of stacked sheets. Then, after the number of stacked sheets reduces and the inclination caused by the height difference of the upper surface of the topmost sheet becomes small, sheet presence detection is performed. This surely prevents the detection of the stacked sheets from disabling because of the inclination of the upper surface of the sheets and stopping the feeding of the sheets even though the sheets remain on the lifter tray 107, and achieves stable and large capacity sheet feeding of a large variety of sheets. As described above, even if a height difference arises on the upper surface of topmost sheet when a large number of the envelopes 120, emboss sheets, or preprinted sheets are stacked, this sheet feeding deck 100 can surely feed sheets extending to the last one.

<Modification 1>

The embodiment adopts a method for detecting the tray position using the protruding portion 119*c* of the position detection lever 119 protruding into the storage 106. However, as in modification 1 illustrated in FIG. 15A, the height of the lifter tray 107 may be detected based on the rotational shift amount of driving by providing, on the rotation shaft of the driving system of the lifter motor M3, a detection member 124 and a rotation angle detection sensor 206 that detect the rotation angle.

Figure 15A:
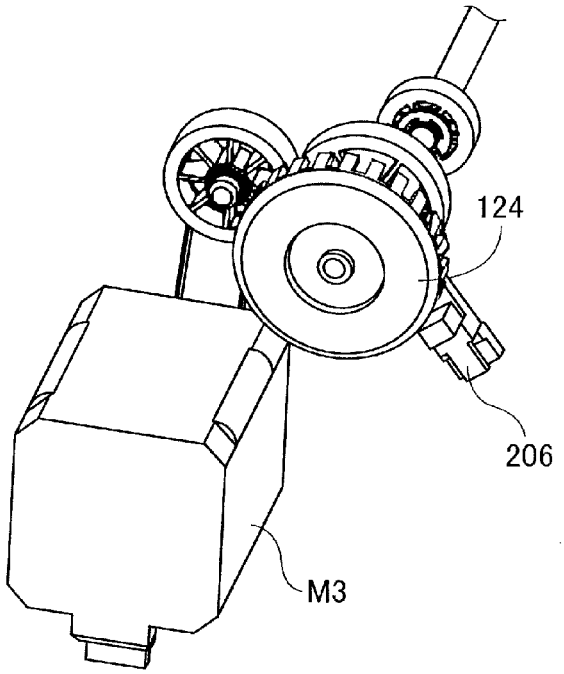
FIG. 15A is a perspective view illustrating modification 1.

The motor M3 in FIG. 15A may be configured as a stepping motor. In this case, the rotation angle detection sensor 206 constitutes the position detecting portion P (see FIG. 6) and detects the height position of the lifter tray 107 by recording the drive rotation pulse count and the like of the stepping motor (M3) and detecting the rotation angle of the rotation shaft of the motor. Accordingly, since the position of the lifter tray 107 can be detected based on the pulse count quantity from a predefined position of the lifter tray 107, the predetermined height (position W) can be set by the pulse count quantity.

<Modification 2>

Figure 15B:
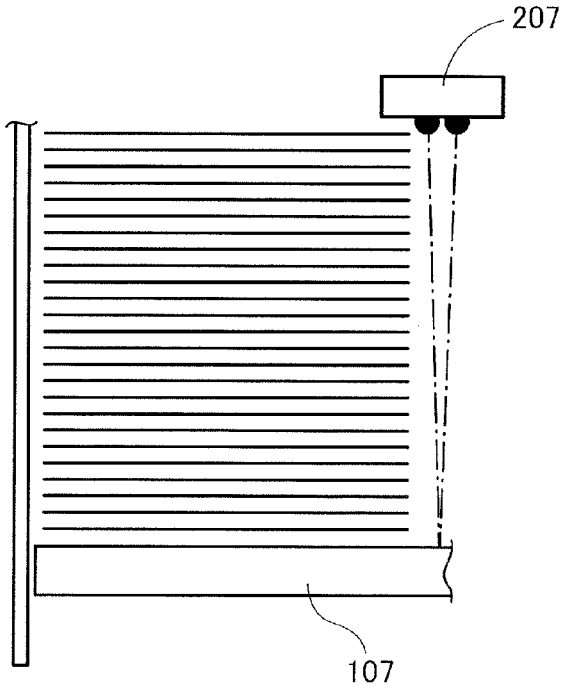
FIG. 15B is a schematic section view illustrating modification 2.

As modification 2 illustrated in FIG. 15B, the height of the lifter tray 107 may be detected by applying a light beam from a reflective optical sensor 207 (ranging sensor) having the light-emitting portion and the light-receiving portion to the stacking surface of the lifter tray 107 and receiving the light reflected by the lifter tray 107. In this case, the optical sensor 207 constitutes the position detecting portion P and emits light to the lifter tray 107 from above, so as to reliably detect the height position of the lifter tray 107 based on a reflection response (intensity and so on) of the light reflected by the lifter tray 107.

According to the embodiment, even when the stacking surface of the topmost sheet fed in a set state is not inclined as in normal cut sheets, the position of the lifter tray 107 can be detected similarly by the position detection lever 119 protruding into the storage 106.

That is, when the position of the lifter tray 107 is above position W (that is, after the number of remaining sheets stacked on the lifter tray 107 is sufficiently small), a signal from the sheet presence detection sensor 201 concerning presence or absence of the lowermost (the last) sheet on the lifter tray 107 is checked. Since the embodiment uses a common control method regardless of the sheet types as described above, occurrence of false detection due to disturbance noise can be suppressed as much as possible by simplifying the control program and performing control so as to check only the area timings that need to be checked (detected).

In the above embodiments, although the sheet presence detecting portion E is disposed upstream in the sheet conveyance direction of the sheet height detecting portion H, this disclosure is not limited to this disposition and the sheet presence detecting portion E may be disposed, for example, downstream in the sheet conveyance direction of the sheet height detecting portion H. This case corresponds to, for example, the case in which sheets having a thick end on the upstream side are stacked.

In the above embodiments, differences in the height of the topmost sheet are covered by disposing the sheet height detection sensor 202 and the sheet presence detection sensor 201 upstream and downstream in the sheet conveyance direction. However, even when the sheet height detection sensor 202 and the sheet presence detection sensor 201 are located on the same side with respect to the sheet conveyance direction and disposed in parallel with respect to the sheet width direction orthogonal to the conveyance direction, the following effects can be obtained. That is, when sheets having large height differences in the width direction are stacked, it is possible to obtain the effects by enabling detection results by the sheet presence detection sensor 201 after the height position of the stacking portion exceeds the predetermined height, as in the embodiment.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-077862, filed Apr. 4, 2014 which is hereby incorporated by reference herein in its entirety.

What is claimed is:

1. A sheet feeding apparatus comprising:

a stacking portion on which sheets are stacked, the stacking portion being movable up and down;

a lifting portion which lifts the stacking portion;

a feeding portion which abuts against a topmost sheet of the sheets stacked on the stacking portion, and feeds the topmost sheet;

a first height detecting portion which outputs a signal corresponding to a position in a height direction of the topmost sheet of the sheets stacked on the stacking portion;

a sheet presence detecting portion which is disposed contactably with the topmost sheet of the sheets stacked on the stacking portion and outputs a signal corresponding to presence or absence of sheets stacked on the stacking portion;

a second height detecting portion which outputs a signal corresponding to a position in a height direction of the stacking portion independent of the position of the topmost sheet in the height direction; and a control portion controlling the lifting portion to perform a lifting operation such that the position of the topmost sheet is kept within a predetermined range by lifting the stacking portion based on the signal from the first height detecting portion, wherein the control portion performs a predetermined control based on the signal from the sheet presence detection portion in a state in which the position of the stacking portion is detected to be above a predetermined height based on the signal from the second height detecting portion, and does not perform the predetermined control in a case in which the position of the stacking portion is detected to be below the predetermined height, in a state in which the stacking portion is positioned at a position such that the topmost sheet is positioned within the predetermined range.

2. The sheet feeding apparatus according to claim 1, wherein the lifting operation of the lifting portion is controlled based on the signal from the first height detecting portion and the signal from the sheet presence detecting portion isn't used, while the position of the stacking portion is below the predetermined height.

3. The sheet feeding apparatus according to claim 1, wherein the predetermined height of the stacking portion is a height in which the feeding portion abuts against a topmost sheet of the sheets stacked inclinedly on the stacking portion and the sheet presence detecting portion is adapted for detecting the topmost sheet, in a state in which the stacking portion is located in a region above the predetermined height.

4. The sheet feeding apparatus according to claim 1, wherein the sheet presence detection portion includes a sheet presence detection lever supported pivotably by an apparatus main body, the sheet presence detection lever which has a distal end portion being disposed contactably with the sheets on the stacking portion, and a sheet presence detection sensor which outputs a signal corresponding to a pivotal position of the sheet present detection lever.

5. The sheet feeding apparatus according to claim 1, wherein the first height detecting portion is disposed contactably with the topmost sheet of the sheets stacked on the stacking portion, and the position at which the sheet presence detecting portion abuts against the sheet is upstream, in the sheet feeding direction, of the position at which the first height detecting portion abuts against the sheet.

6. The sheet feeding apparatus according to claim 1 further comprising:

a display portion which displays information concerning an absence of sheets, and wherein the predetermined control controls displaying the information concerning the absence of sheets on the display portion based on the signal of the sheet presence detecting portion.

7. The sheet feeding apparatus according to claim 1, wherein the predetermined control is a control of stopping a sheet feeding operation of the feeding portion based on the signal from the sheet presence detecting portion.

8. The sheet feeding apparatus according to claim 1, wherein the second height detecting portion includes a position detection member disposed pivotably, the position detection member being abuttable against the stacking portion to be elevated or lowered, and a position detection sensor which outputs a signal corresponding to a pivotal position of the position detection member.

9. The sheet feeding apparatus according to claim 1, wherein the lifting portion has a stepping motor as a driving source, the second height detecting portion outputs a signal corresponding to pulse counts of the stepping motor, and a height position of the stacking portion is computed by the control portion based on the signal corresponding to the pulse counts of the stepping motor.

10. The sheet feeding apparatus according to claim 1, wherein the second height detecting portion has an optical sensor emitting light to the stacking portion from above and outputting a signal based on a reflection response of the light reflected by the stacking portion, and a height position of the stacking portion is computed by the control portion based on the signal from the optical sensor.

11. The sheet feeding apparatus according to claim 1, wherein the feeding portion is a feeding roller pivotably supported, the first height detecting portion has a sheet height detection sensor which outputs a signal corresponding to a height position of the feeding roller, and the lifting portion is controlled by the control portion based on a signal from the sheet height detection sensor.

12. The sheet feeding apparatus according to claim 1, wherein the first height detecting portion includes a first contact portion adapted for contacting to a sheet, and the first contact portion contacts to the topmost sheet of the sheets stacked on the stacking portion when the sheets are stacked on the stacking portion and contacts to the stacking portion when the sheets are not stacked on the stacking portion, and the sheet presence detection portion includes a second contact portion adapted for contacting to a sheet, and the second contact portion contacts to the topmost sheet of the sheets stacked on the stacking portion when the sheets are stacked on the stacking portion and is dropped in a hole portion formed at the stacking portion when the sheets are not stacked on the stacking portion.

13. The sheet feeding apparatus according to claim 1, wherein the control portion determines presence and absence of the sheets on the stacking portion based on the signal from the first height detecting portion and the signal from the sheet presence detection portion.

14. An image forming apparatus comprising:

a stacking portion on which sheets are stacked, the stacking portion being movable up and down;

a lifting portion which lifts the stacking portion;

a feeding portion which abuts against a topmost sheet of the sheets stacked on the stacking portion, and feeds the topmost sheet;

a first height detecting portion which outputs a signal corresponding to a position in a height direction of the topmost sheet of the sheets stacked on the stacking portion;

a sheet presence detecting portion which is disposed contactably with the topmost sheet of the sheets stacked on the stacking portion and outputs a signal corresponding to presence or absence of the sheets stacked on the stacking portion;

a second height detecting portion which outputs a signal corresponding to a position in a height direction of the stacking portion independent of the position of the topmost sheet in the height direction;

a control portion controlling the lifting portion to perform a lifting operation such that the position of the topmost sheet is kept within a predetermined range by lifting the stacking portion based on the signal from the first height detecting portion, wherein the control portion performs a predetermined control based on the signal from the sheet presence detection portion in a state in which the position of the stacking portion is detected to be above a predetermined height based on the signal from the second height detecting portion, and does not perform the predetermined control in a case in which the position of the stacking portion is detected to be below the predetermined height, in a state in which the stacking portion is positioned at a position such that the topmost sheet is positioned within the predetermined range; and an image forming portion forming an image on a sheet fed from the feeding portion.

15. A sheet feeding apparatus comprising:

a stacking portion on which sheets are stacked and which is movable up and down;

a lifting portion which lifts the stacking portion;

a feeding portion which abuts against a topmost sheet of the sheets stacked on the stacking portion, and feeds the topmost sheet;

a first height detecting portion which outputs a signal corresponding to whether a position in a height direction of the feeding portion is located in a feeding position at which the topmost sheet is fed;

a sheet presence detection portion which is disposed contactably with the topmost sheet of the sheets stacked on the stacking portion and outputs a signal corresponding to presence or absence of sheets stacked on the stacking portion;

a second height detecting portion which outputs a signal corresponding to whether a position in a height direction of the stacking portion is located in a first region in which case a predetermined control is not performed or a second region in which case the predetermined control is performed based on the signal from the sheet presence detection portion; and a control portion controlling the sheet feeding apparatus in a sheet feeding operation, wherein the control portion is configured to receive detecting signals from the first height detecting portion, the sheet presence detection portion and the second height detecting portion, the control portion is configured to prevent the sheet presence detection portion from detecting or to disable the detection if the signal indicating that the stacking portion is located in the first region is output from the second height detecting portion, and the control portion is configured to permit the sheet presence detecting portion to detect if the signal indicating that the stacking portion is located in the second region is output from the second height detecting portion.

* * * * *